US010374351B2

(12) United States Patent
Goto et al.

(10) Patent No.: US 10,374,351 B2
(45) Date of Patent: Aug. 6, 2019

(54) CONNECTOR

(71) Applicant: Sumitomo Wiring Systems, Ltd., Yokkaichi, Mie (JP)

(72) Inventors: Yuichi Goto, Mie (JP); Yoshihiro Mizutani, Mie (JP); Hiroko Nishii, Mie (JP); Yusuke Hamada, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/030,905

(22) Filed: Jul. 10, 2018

(65) Prior Publication Data

US 2019/0027858 A1 Jan. 24, 2019

(30) Foreign Application Priority Data

Jul. 18, 2017 (JP) ..... 2017-138749

(51) Int. Cl.

| | |
|---|---|
| ***H01R 13/52*** | (2006.01) |
| ***H01R 13/514*** | (2006.01) |
| ***H01R 27/02*** | (2006.01) |
| ***H01R 13/629*** | (2006.01) |

(52) U.S. Cl.

CPC ..... *H01R 13/514* (2013.01); *H01R 13/52* (2013.01); *H01R 13/62938* (2013.01); *H01R 27/02* (2013.01)

(58) Field of Classification Search

CPC ..... H01R 13/514; H01R 13/3869; H01R 13/4223; H01R 13/6272; H01R 13/639; H01R 27/02; H01R 13/52

USPC ..... 439/519

See application file for complete search history.

(56) References Cited

U.S. PATENT DOCUMENTS

2005/0136725 A1* 6/2005 Matsunaga ..... H01R 13/6272 439/350
2005/0148229 A1* 7/2005 Matsunaga ..... H01R 13/4223 439/352
2010/0190369 A1* 7/2010 Byrne ..... H01R 4/185 439/215
2014/0093210 A1* 4/2014 Youngkin ..... G02B 6/3869 385/56
2015/0111407 A1* 4/2015 Hashimoto ..... H01R 13/639 439/352
2015/0115598 A1* 4/2015 Lombardi, III ..... F16L 37/0985 285/124.1
2015/0293310 A1* 10/2015 Kanno ..... G02B 6/3891 385/78
2015/0318639 A1* 11/2015 Hara ..... H01R 13/639 439/345
2016/0062056 A1* 3/2016 Becker ..... G02B 6/3893 439/282

FOREIGN PATENT DOCUMENTS

JP 2000-58192 2/2000

* cited by examiner

*Primary Examiner* — Jean F Duverne
(74) *Attorney, Agent, or Firm* — Gerald E. Hespos; Michael J. Porco; Matthew T. Hespos

(57) ABSTRACT

A connector is composed of a male connector including a receptacle and a female connector including a body portion to be fit into the receptacle, the body portion being fit into the receptacle in a horizontal direction. The female connector is provided with a small receptacle disposed outside the receptacle in a connected state to the male connector to cover an upper part of a tip of the receptacle.

4 Claims, 26 Drawing Sheets

CONNECTOR

BACKGROUND

Field of the Invention

This specification relates to a connector.

Description of the Related Art

Japanese Unexamined Patent Publication No. 2000-58192 discloses a non-waterproof connector used as a connector generally installed in a vehicle interior. It is not necessary to configure a receptacle having a double structure and a sealing member, such as a rubber ring, is not needed. Thus, the non-waterproof connector can have a simple structure and can be small.

However, water may fall on a connector in a vehicle interior and may penetrate into the connector through a clearance, such as when an umbrella carrying rainwater is brought into the vehicle or a drink is spilled. Thus, even a connector used in a vehicle should be waterproof. However, a waterproof connector requires a receptacle having a double structure and a sealing member, thereby enlarging the connector.

This specification was completed on the basis of the above situation and aims to provide a connector having a small size and making it difficult for water to easily penetrate into the inside of the connector.

SUMMARY

This specification is directed to a connector with a male connector including a receptacle and a female connector including a body to be fit into the receptacle. The body is fit into the receptacle in a horizontal direction. The female connector has a small receptacle disposed outside the receptacle in a connected state to the male connector to cover an upper part of a tip of the receptacle.

According to this configuration, even if rainwater on an umbrella falls on the connector from above or drink spills over the connector, water flows down along the small receptacle and does not penetrate into the connector through a clearance between the receptacle and the body since a tip part of the receptacle of the connector in the connected state, i.e. a boundary between the male connector (receptacle) and the female connector (body) is covered from above by the small receptacle. Additionally, the small receptacle only covers the tip part of the receptacle from above and is not provided in a lower part of the connector. Thus, the connector has a simple structure and is small as compared to general waterproof connectors.

Note that the upper part mentioned above means not only an area facing an upper surface of the receptacle, but also upper areas of side surfaces of the receptacle.

The receptacle and the body may have guides that face each other in the connected state and guide the male connector and the female connector in a connecting direction by convex-concave engagement extending along the connecting direction. Two of the guides may be at positions below and adjacent to a lower end of the small receptacle and facing each other with respect to the body.

One of the guides may be a male-side guiding rib projecting in on the receptacle and a female-side guiding groove in the body. Another guide may be a female-side guiding rib projecting out on the body and a male-side guiding groove in the receptacle. According to these configurations, even if the small receptacle is provided on the female connector, a guiding function at the time of connection can be obtained by the guides for guiding the male and female connectors in the connecting direction at positions close to an end part of the connector and facing each other with respect to the body.

The guiding function can be more effective by providing the male-side guiding rib projecting in from the receptacle and the female-side guiding rib projecting out from the body at the positions facing each other with respect to the body.

The body may be formed by assembling divided bodies divided along the connecting direction of the male and female connectors. A cut may be formed along the connecting direction on at least one side edge part of the divided bodies disposed along the connecting direction of the male and female connectors. The cut may serve as a female-side guiding groove configured to receive a male-side guiding rib projecting in along the connecting direction on the receptacle. According to this configuration, a part of an area of an assembling mechanism for assembling the divided bodies can be utilized as an area where the guiding portions are provided.

According to this specification, a connector has a small size and makes it difficult for water to penetrate into the inside of the connector.

DETAILED DESCRIPTION

Figure 2:
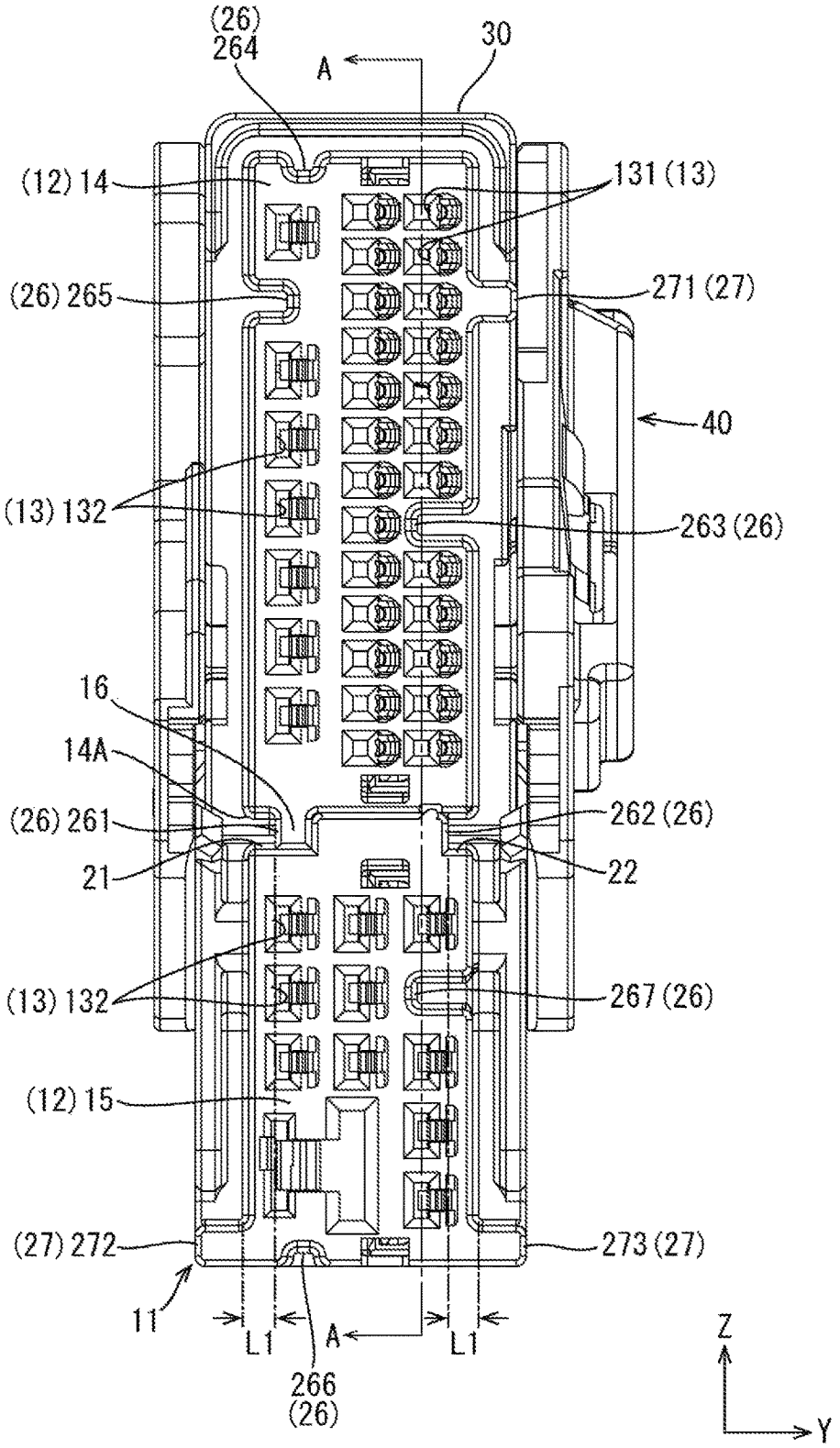
FIG. 2 is a front view of the female connector.
Figure 3:
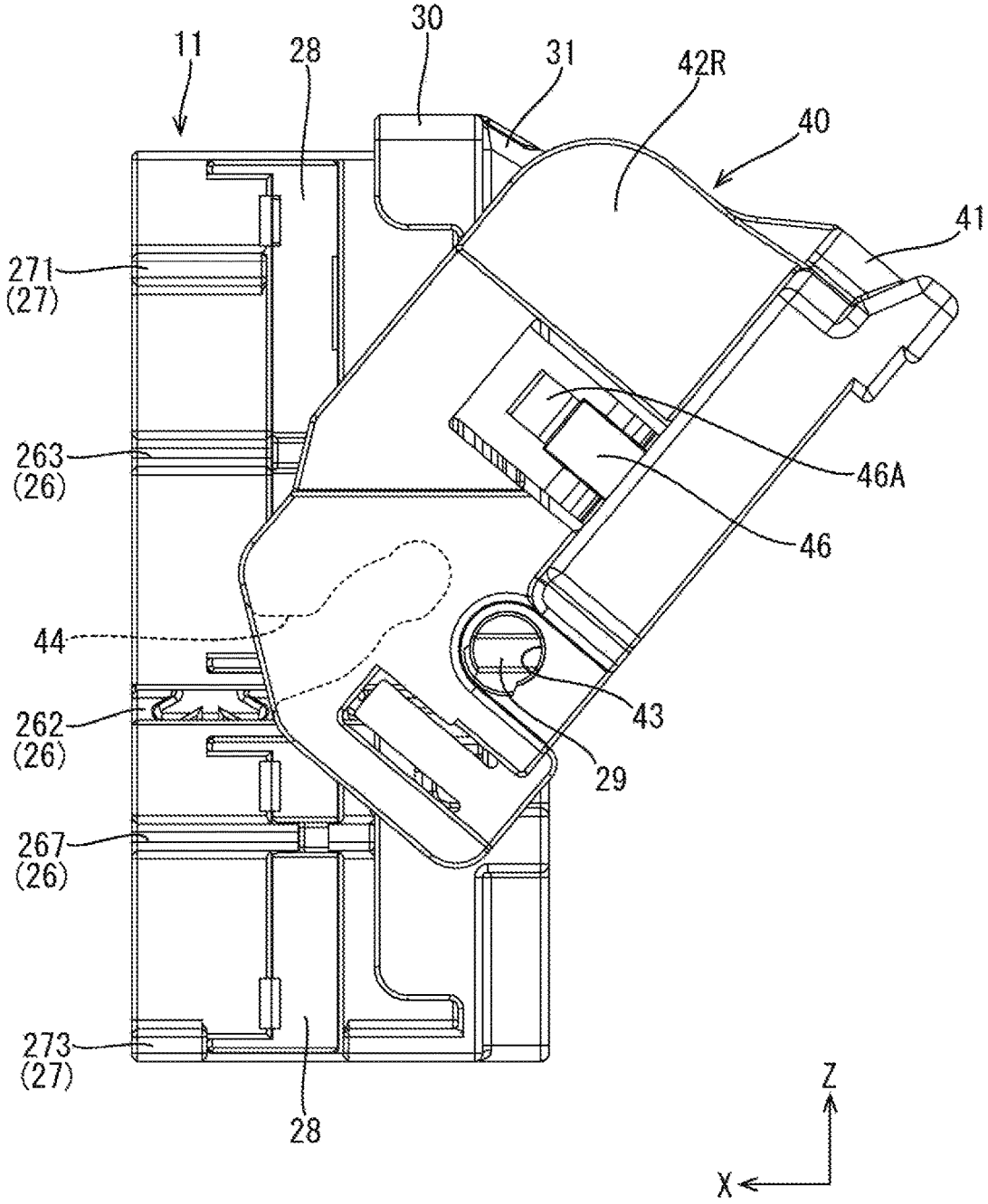
FIG. 3 is a right side view of the female connector.

A connector 1 in accordance with one embodiment includes a female connector 10 and a male connector 50 connectable to each other. A lever 40 is mounted on the female connector 10 and can be rotated to connect the female and male connectors 10, 50. In the following description, a connection surface and an opposite side on the basis of a connecting direction of the female and male connectors 10, 50 are referred to respectively as a front and a rear. Further, an upper side and a lower side of FIG. 2 are referred to as an upper side and a lower side on the basis of an installation direction of the female and male connectors 10, 50. Furthermore, a right side (right side of FIG. 2) and a left side when the female connector 10 is viewed from the front are referred to as a right side and a left side.

Figure 1:
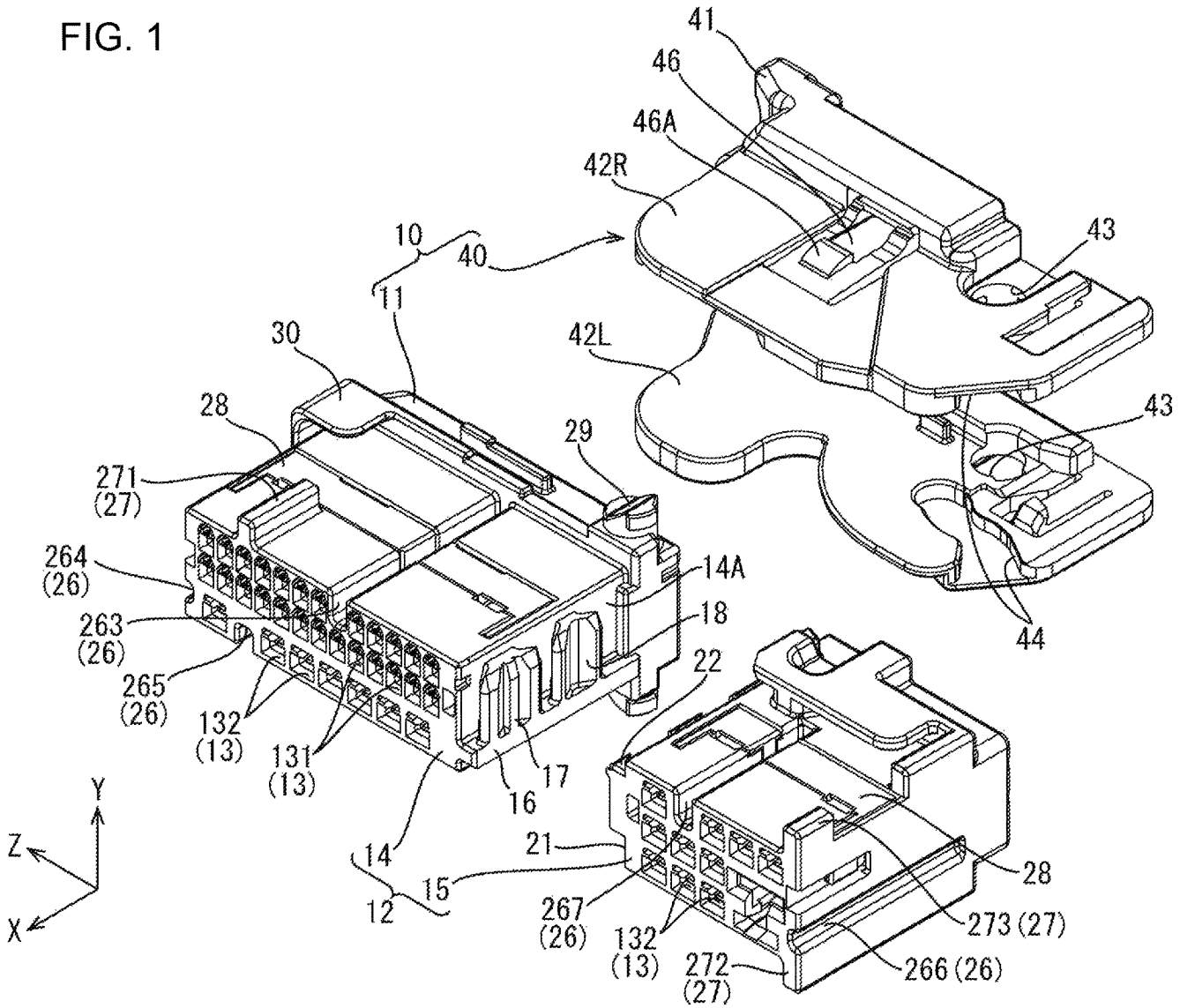
FIG. 1 is an exploded perspective view of a female connector of one embodiment.

The female connector 10 shown in FIGS. 1 to 8 includes a female connector housing 11 made of synthetic resin, female terminals (not shown) and a lever 40. The female connector housing 11 includes a block-like body 12, as shown in FIG. 1, and the female terminals are accommodated into cavities 13 that penetrate through the body 12 in a front-rear direction from behind. Note that although the female connector housing 11 of FIG. 1 is laid sideways to facilitate description, a left side in FIG. 1 is disposed on an upper side when the female connector 10 is installed in a vehicle.

The body 12 is a vertically long rectangular parallelepiped as shown in a front view of FIG. 2, and a dimension in a height (vertical) direction is about three times as large as a dimension in a width (lateral) direction.

The body 12 is formed by assembling two members divided along a connecting direction X. One member is a first divided body 14 to be disposed on an upper side and the other member is a second divided body 15 to be disposed on a lower side. A ratio of the first divided body 14 to the second divided body 15 in the height direction is about 2:1 and dimensions of the first and second divided bodies 14, 15 in the width (lateral) direction and a depth (front-rear) direction are equal.

An abutting rib 16 extending in the connecting direction X (front-rear direction) from a front end and projects at a position spaced by a predetermined distance L1 from a left end in an area of a facing surface 14A of the first divided body 14 facing the second divided body 15 near a left end. Further, a first ridge 17 and a second ridge 18 project in an area of the facing surface 14A near a front end and extend in a direction Y (lateral direction) perpendicular to the connecting direction X. The first ridge 17 is disposed on a front side and has three pieces that protrude substantially radially toward a lateral side from a base end side. The second ridge 18 is disposed on a rear side and has two pieces that protrude radially toward the lateral side from a base end side.

The two ridges 17, 18 extend continuously toward a right side (upper side in FIG. 1) from the abutting rib 16 to positions spaced by the predetermined distance L1 from a right edge of the facing surface 14A. Projecting dimensions of the ridges 17, 18 from the facing surface 14A are equal to that of the abutting rib 16 from the facing surface 14A, so that tip surfaces in a projecting direction are flush with each other.

On the other hand, side edges of the second divided body 15 facing the first divided body 14 include a left side edge part that is cut to have an L-shaped cross-section along the connecting direction (front-rear direction) from a front end to form a first cut portion 21. Lower and right side surfaces of the abutting rib 16 of the first divided body 14 are held in contact with cut surfaces of the first cut 21 (see FIG. 2). Further, a right side edge part is also cut to have an L-shaped cross-section from the front end to form a second cut 22.

Two receiving grooves 23, 24 extend in the lateral direction (Y direction) in a central area between the first and second cuts 21, 22 on a facing surface 15A of the second divided body 15 facing the first divided body 14 (see FIG. 4) and receive the two ridges 17, 18. Each receiving groove 23, 24 has a substantially C-shaped cross-section widened from an opening toward a bottom side of the groove so that the ridge portion 17, 18 can be fit thereinto.

Figure 4:
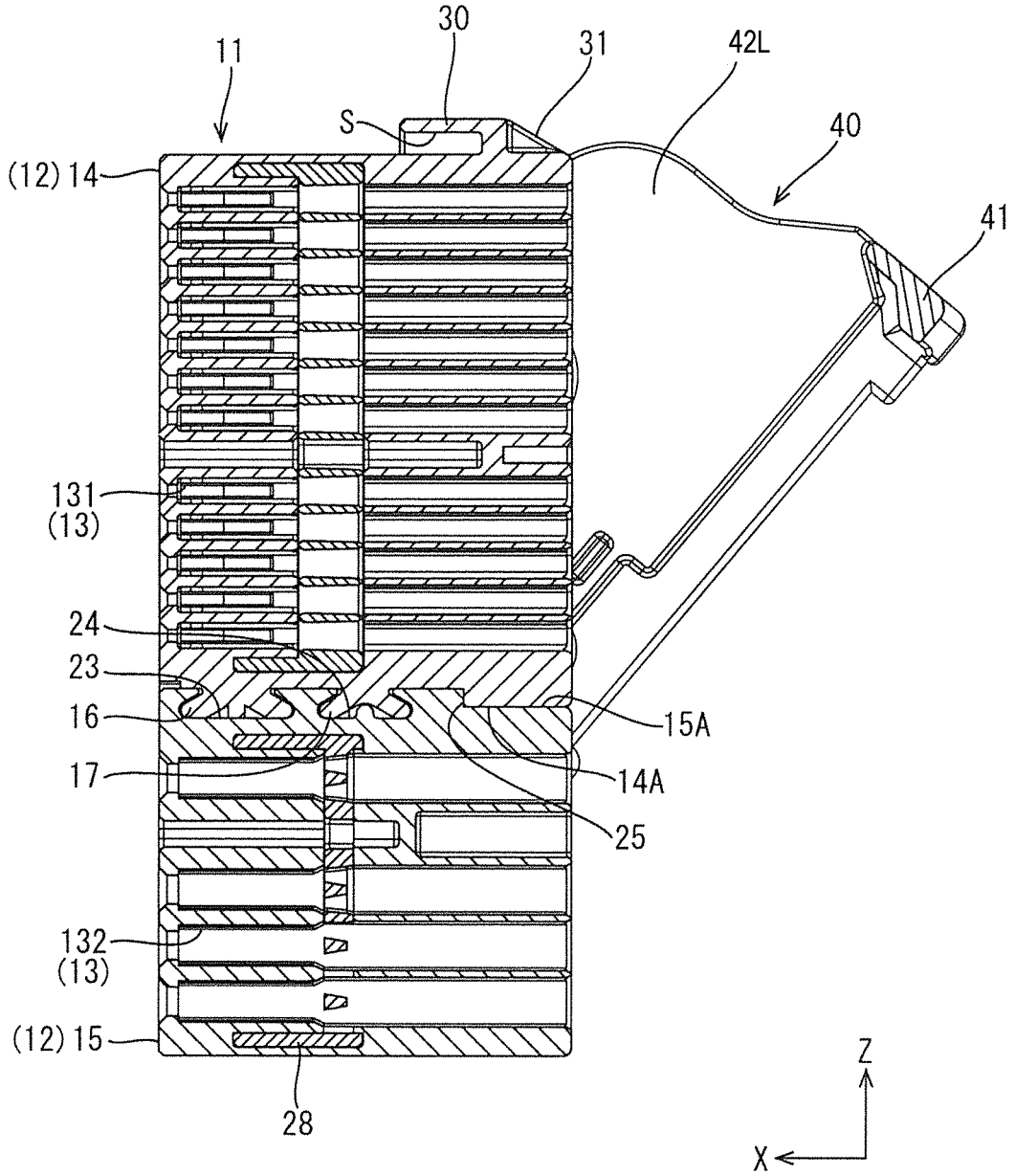
FIG. 4 is a section along A-A of FIG. 2.
Figure 5:
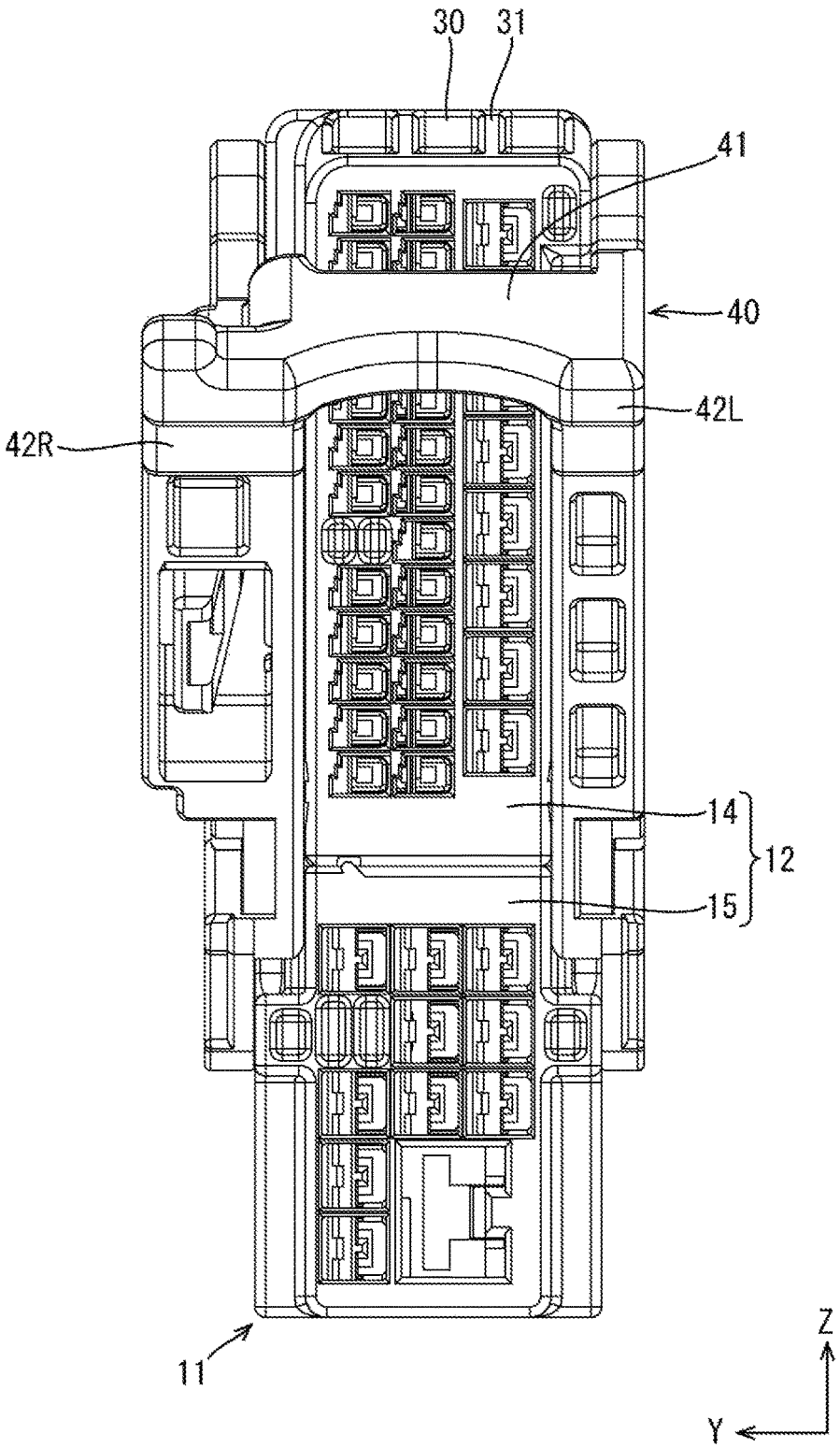
FIG. 5 is a back view of the female connector.
Figure 6:
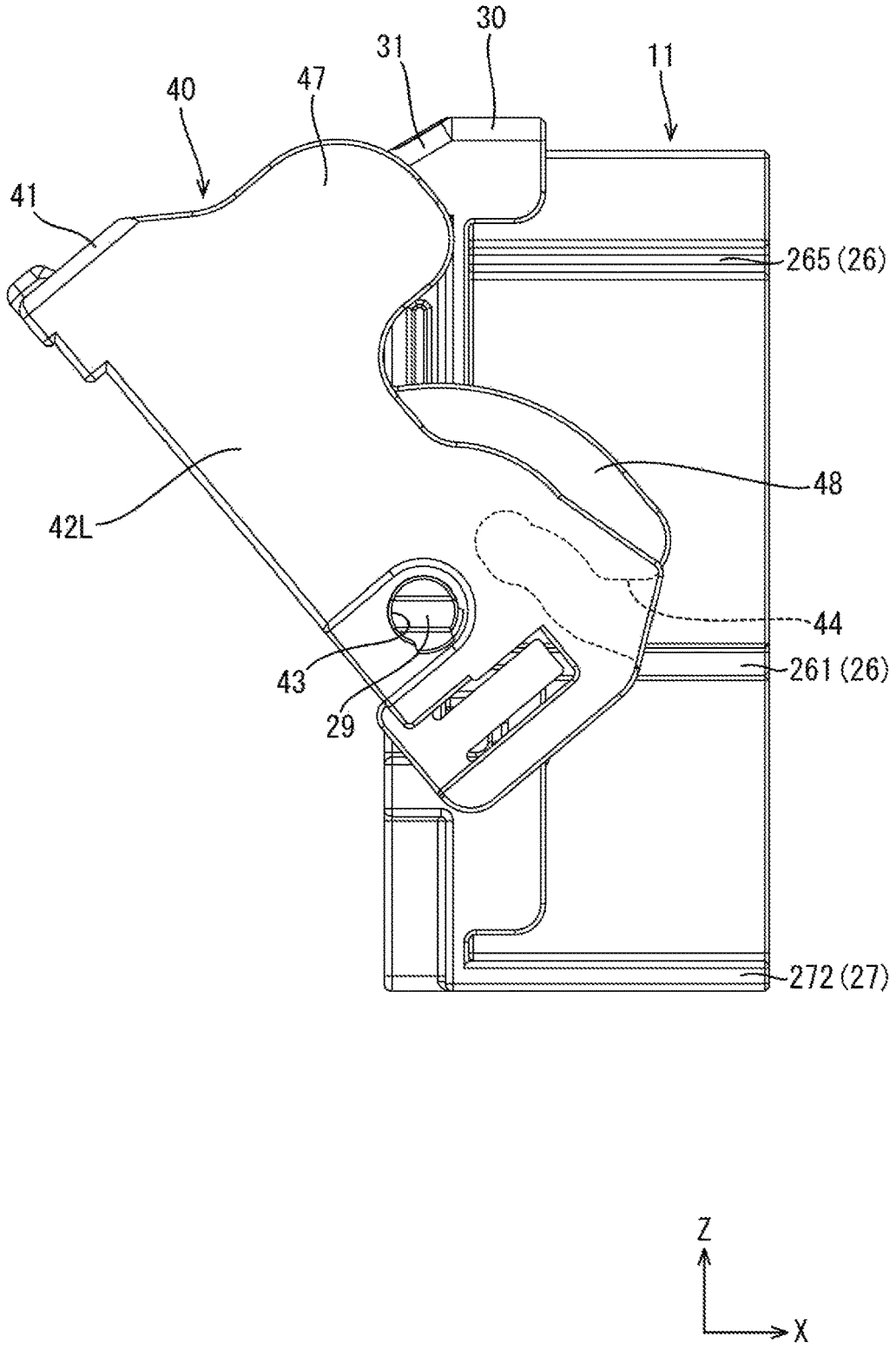
FIG. 6 is a left side view of the female connector.
Figure 7:
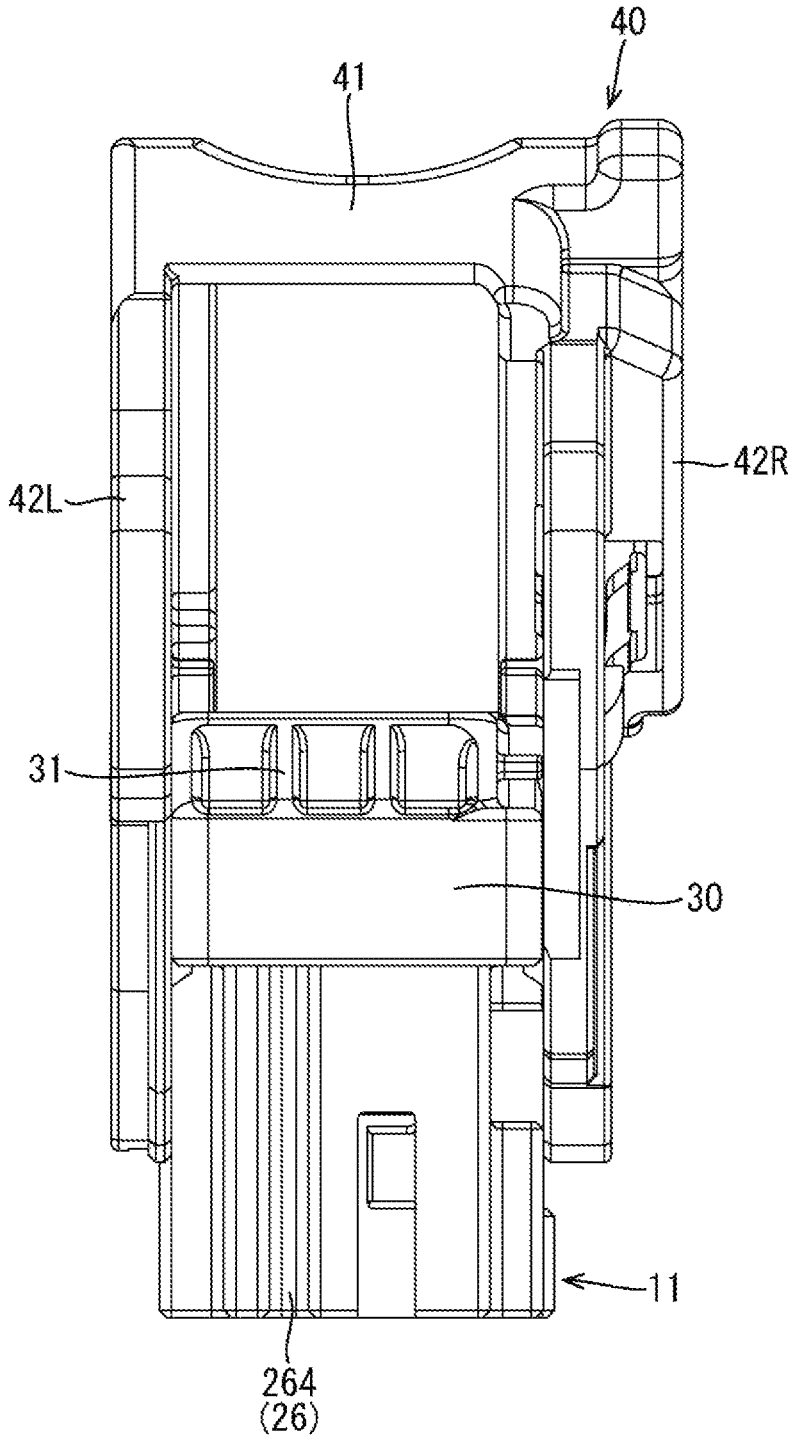
FIG. 7 is a plan view of the female connector.
Figure 8:
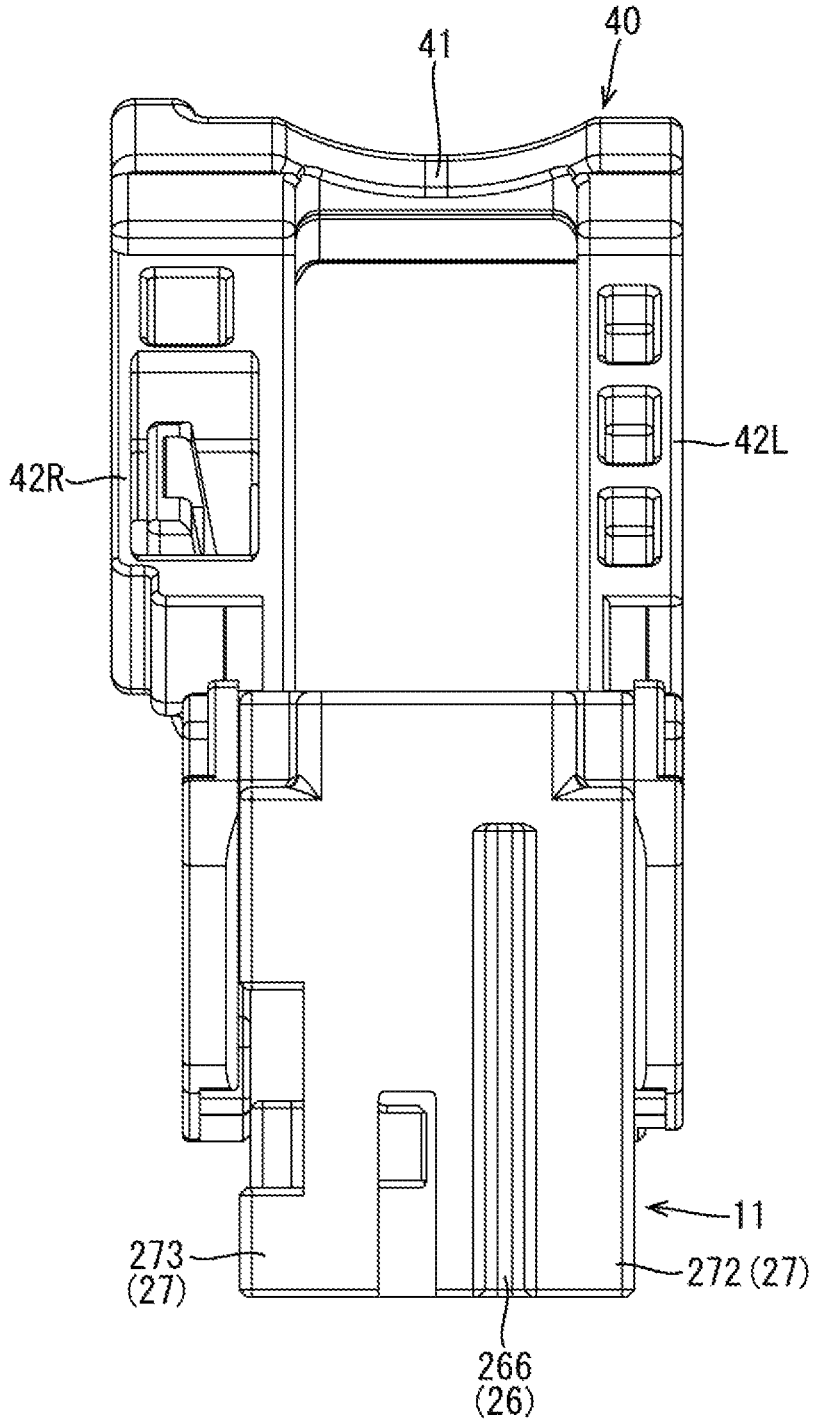
FIG. 8 is a bottom view of the female connector.

Further, as shown in FIG. 4, a step 25 is provided behind the ridges 17, 18 and the receiving grooves 23, 24 (right side in FIG. 4) in which the facing surface 14A of the first divided body 14 projects and the facing surface 15A of the second divided body 15 is recessed. The first and second divided bodies 14, 15 are assembled integrally by the ridges 17, 18, the receiving grooves 23, 24 and the step 25 being meshed with each other while relatively sliding in the lateral direction (Y direction).

An area of the assembled body 12 enclosed by the facing surface 14A of the first divided body 14, the left side surface of the abutting rib 16 and the first cut 21 serves as a female-side first guiding groove 261 that extends in the front-rear direction from the left side surface of the body 12. An area enclosed by the facing surface 14A of the first divided body 14 and the second cut 22 (including ring end surfaces of the ridges 17, 18) serves as a female-side second guiding groove 262 extending in the front-rear direction from the right side surface of the body 12, as shown in FIG. 2. Both of the female-side first and second guiding grooves 261, 262 have a groove depth L1 and are formed at positions facing each other with respect to the body portion 12.

The body 12 is provided with five female-side guiding grooves 26 extending in the connecting direction (front-rear direction) from the front end besides the female-side first and second guiding grooves 261, 262. Hereinafter, the guiding groove provided near a center of the right side surface of the first divided body 14 in the height direction is referred to as a female-side third guiding groove 263, the guiding groove provided in the upper surface is referred to as a female-side fourth guiding groove 264, the guiding groove provided near the upper end in the left side surface is referred to as a female-side fifth guiding groove 265, the guiding groove provided in the bottom surface of the second divided body 15 is referred to as a female-side sixth guiding groove 266, and the guiding groove provided near a center of the right side surface in the height direction is referred to as a female-side seventh guiding groove 267. The female-side fourth and sixth guiding grooves 264, 266 are formed at positions facing each other with respect to the body 12.

The body 12 is provided with a female-side first guiding rib 271 projecting outward and extending in the connecting direction X (front-rear direction) from the front end at a position of the right side surface of the first divided body 14 facing the female-side fifth guiding groove 265. Further, a female-side second guiding rib 272 and a female-side third guiding rib 273 project on lower ends of the left and right side surfaces of the second divided body 15 are formed similar to the female-side first guiding rib 271 and face each other. The female-side second and third guiding ribs 272, 273 are provided on a lower end of the body 12.

The body 12 is provided with the cavities 13 penetrating in the front-rear direction. Specifically, first cavities 131 are provided in two lateral rows in the first divided body 14 and second cavities 132 larger than the first cavities 131 are provided in a row side by side with the first cavities 131. Further, second cavities 132 are provided in three lateral rows in the second divided body 15.

A locking lance is provided on a right wall inside each cavity 13. The female connector housing 11 is laid so that the left side surface is disposed below (state of FIG. 1) for insertion of the unillustrated female terminals into the cavities 13. The female terminals connected to wires then are inserted from behind and retainers 28 are mounted from a right side (upper side in FIG. 1) to retain the female terminals.

The female connector 10 then is turned 90° and installed vertically so that a small receptacle 30 is disposed on an upper side for installing the female connector 10 at a predetermined position of the vehicle. By doing so, the female terminals can be mounted more smoothly in the cavities 13.

The female connector housing 11 is provided with the small receptacle 30 that is U-shaped in a front view to cover an upper side and parts of lateral sides of the body portion 12. As shown in FIG. 4, the small receptacle 30 rises out from the vicinity of a rear end (right end of FIG. 4) of the body 12 and extends forward to have a substantially L-shaped cross-section. Obliquely extending guiding portions 31 are provided on a rear outer surface of the small receptacle 30 to couple the upper surface of the small receptacle 30 and the back surface of the body 12 and also to couple the back surface of the small receptacle 30 and the upper surface of the body 12 (see FIG. 21).

A front end of the small receptacle 30 is slightly behind a central part of the body 12 in the front-rear direction (X direction) and covers only a rear area of the body 12 in the front-rear direction. Further, the small receptacle 30 covers only upper areas of the right and left side surfaces of the body 12. Note that a space between the inner peripheral surface of the small receptacle 30 and the outer peripheral surface of the body 12 serves as a fitting space S dimensioned so that a tip of a receptacle 52 to be described later can be fit tightly therein.

Note that the female-side first guiding rib 271 and the female-side fifth guiding groove 265 are provided at positions below and adjacent to a lower end of the small receptacle 30 and facing each other with respect to the body 12.

The lever 40 is mounted on the female connector housing 11 for rotation between a standby position and a connection position. The lever 40 is substantially U-shaped, for example, as shown in a back view of FIG. 5 and has an operating portion 41 and right and left plate-like arms 42R and 42L coupled to both end parts of the operating portion 41 and disposed to face each other.

The arms 42R, 42L are provided with rotation holes 43. Rotary shafts 29 project from both side surfaces of the body 12 of the female connector housing 11 and fit into the rotation holes 43 to support the lever 40 rotatably with respect to the female connector housing 11. As the lever 40 is rotated, the female and male connectors 10, 50 are connected by a cam action between cam grooves 44 on an inner side of the lever 40 and cam pins 56 of a male connector housing 51 to be described later.

The right arm 42R of the lever 40 has a lock piece 46 (see FIG. 1). A locking claw 46A on the tip of the lock piece 46 is locked to a lock hole 62 of the later-described male connector housing 51 when the lever 40 is disposed at the connection position. Thus, the female and male connectors 10, 50 are locked in a connected state.

An escaping portion 49 is provided on an inner side of the right arm 42R (see FIG. 23) to allow a male-side guiding groove 541 to escape, as described later.

Figure 24:
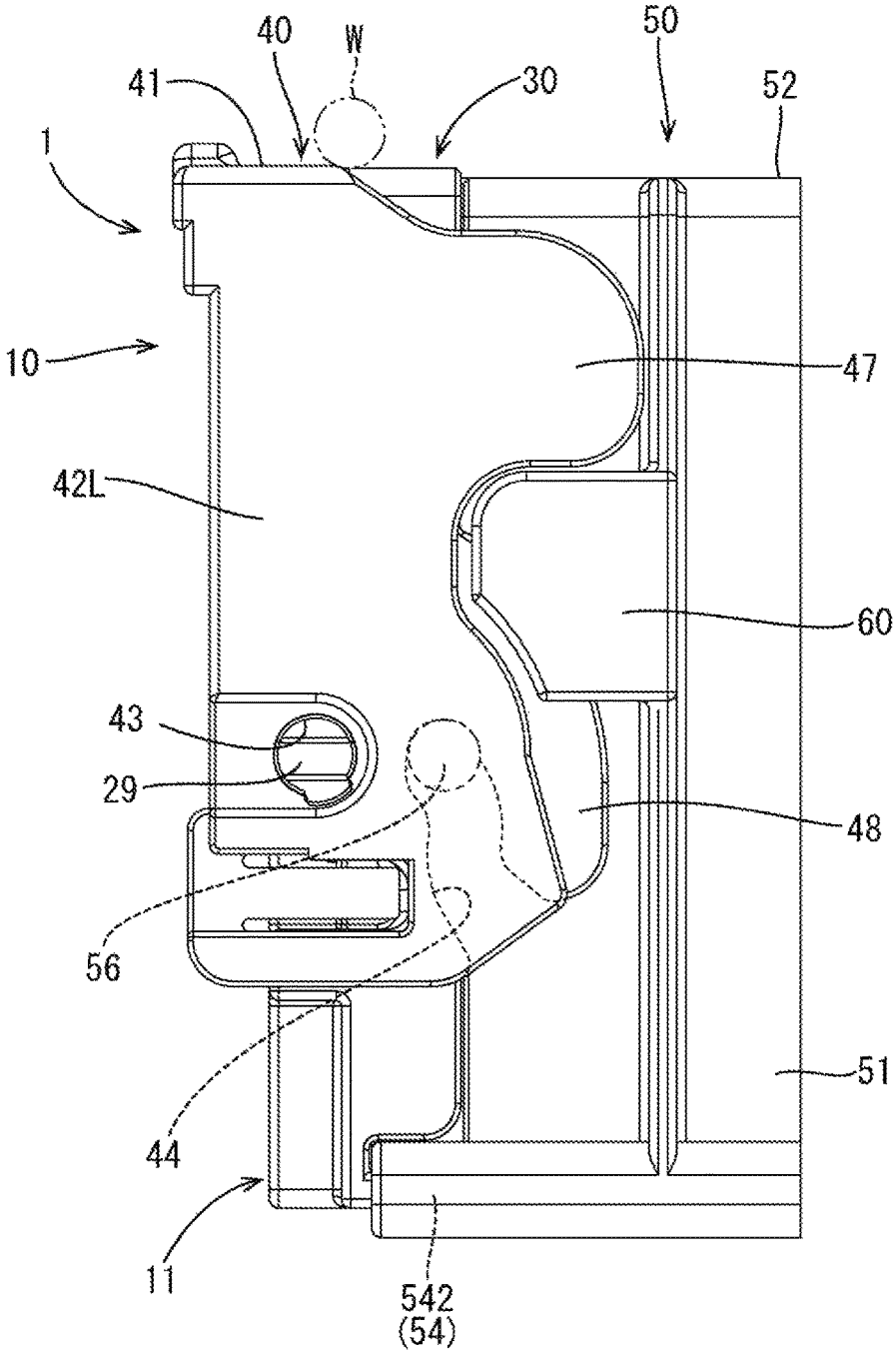
FIG. 24 is a left side view of the connector in the connected state.
Figure 25:
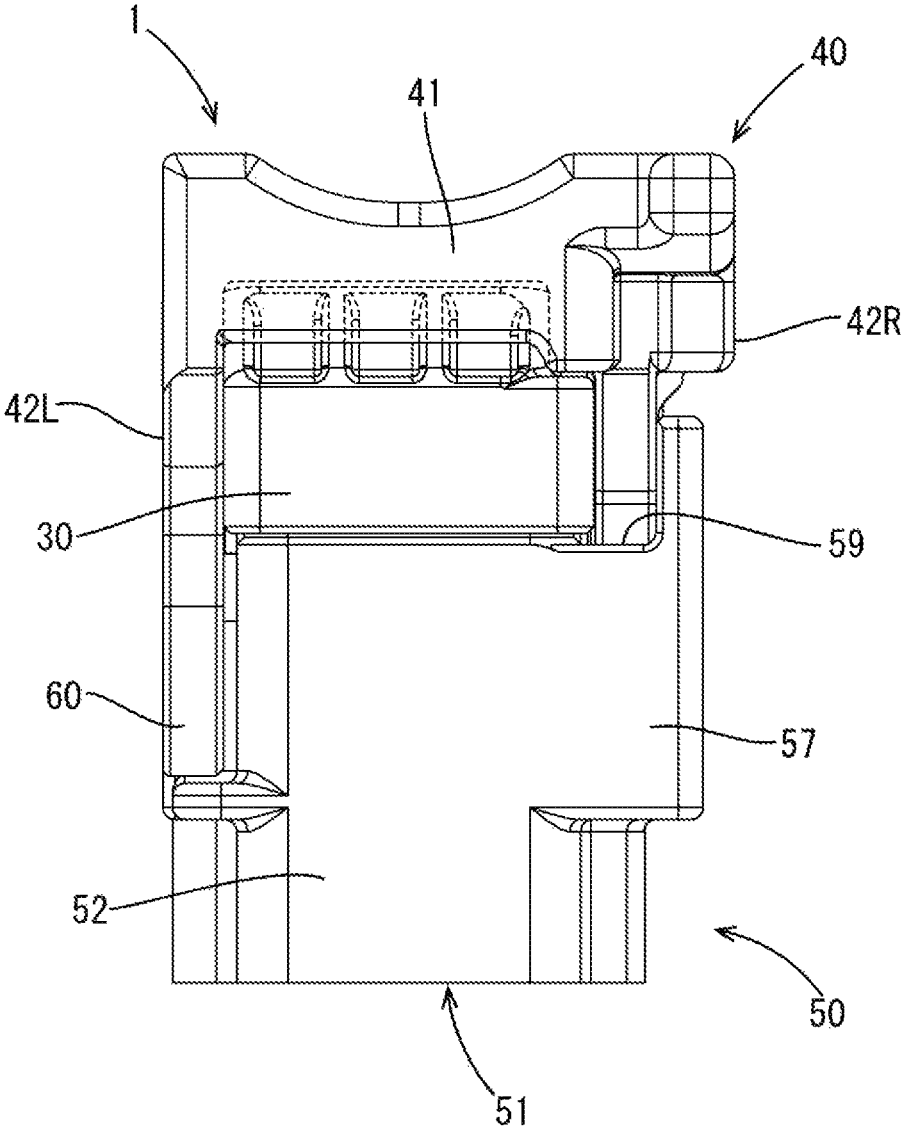
FIG. 25 is a plan view of the connector in the connected state.
Figure 26:
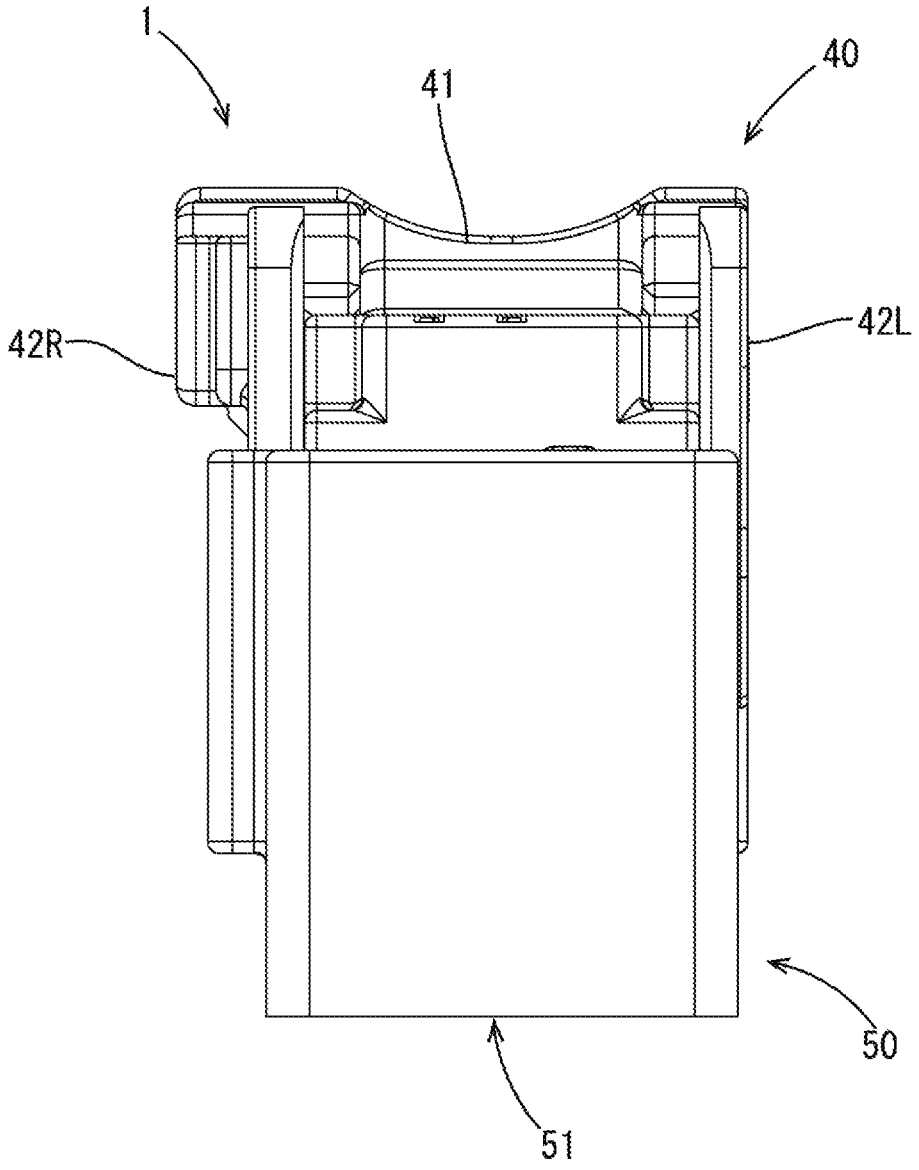
FIG. 26 is a bottom view of the connector in the connected state.

A protruding portion 47 protrudes forward (right in FIG. 24) and has a substantially semicircular shape at an area of the left arm 42L of the lever 40 on a base end side (upper side in FIG. 24) adjacent to the operating portion 41 when the lever is at the connection position of FIG. 24. The protruding portion 47 protrudes while having a smooth side edge continuous from the base end. A retaining portion 48 protrudes forward more gently than the protruding portion 47 at an area of the left arm 42L closer to a tip (lower side in FIG. 24) than the protruding portion 47. The retaining portion 48 has an outer surface recessed along an edge thereof and is configured to engage a restricting portion 60 to restrict separation from the female connector housing 11 when at the connection position.

Figure 14:
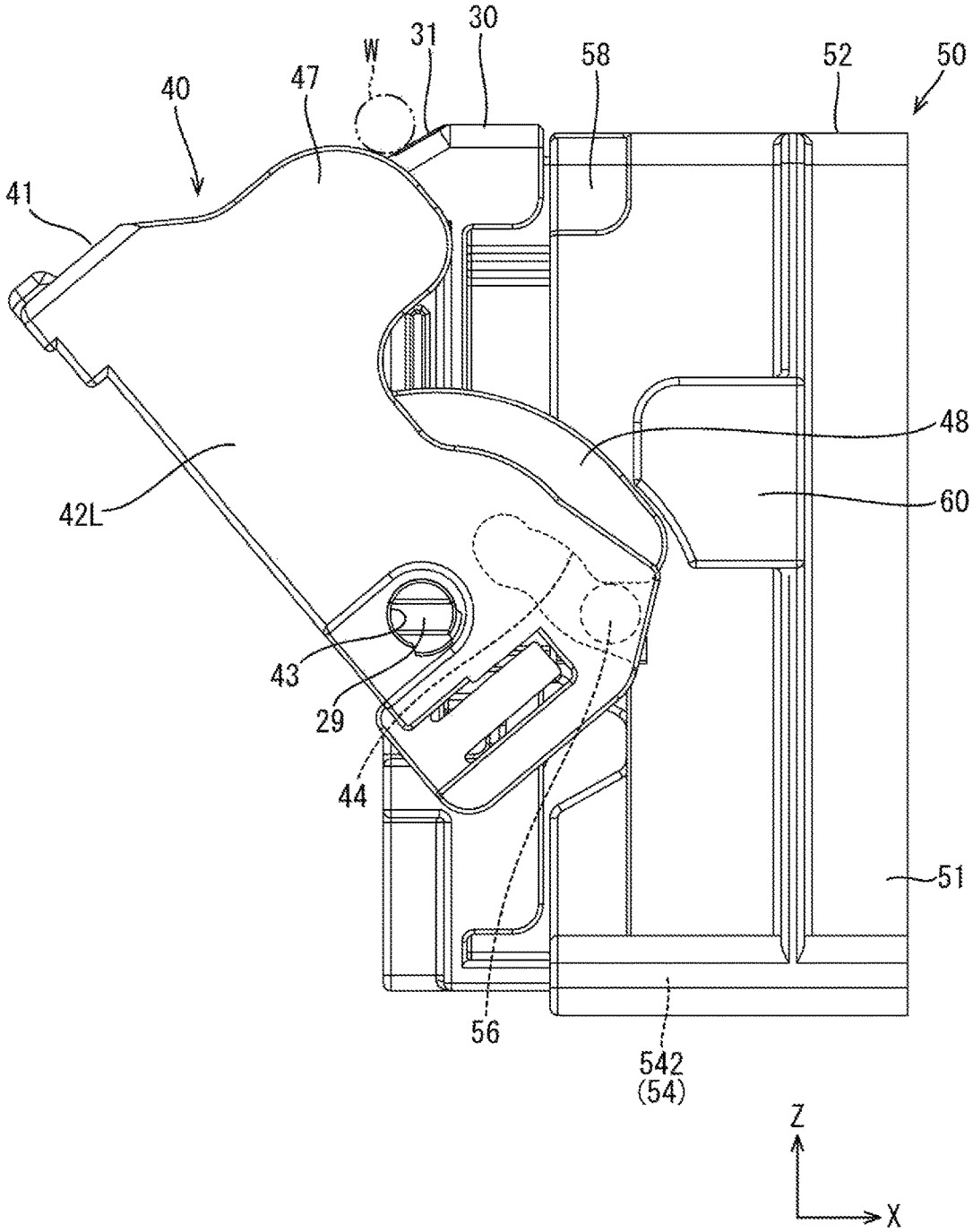
FIG. 14 is a left side view of the connector in the connecting process.
Figure 15:
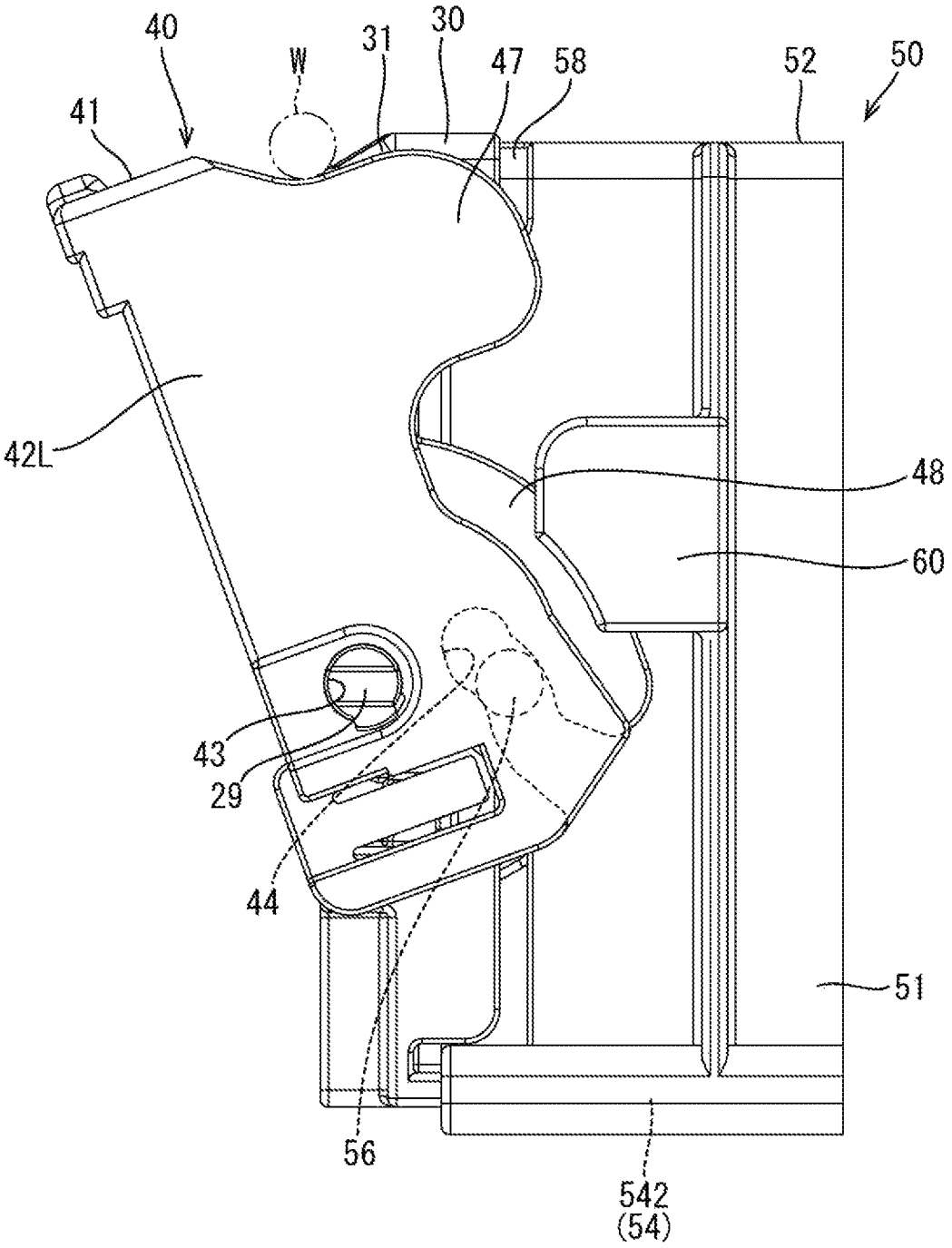
FIG. 15 is a left side view of the connector in the connecting process.
Figure 16:
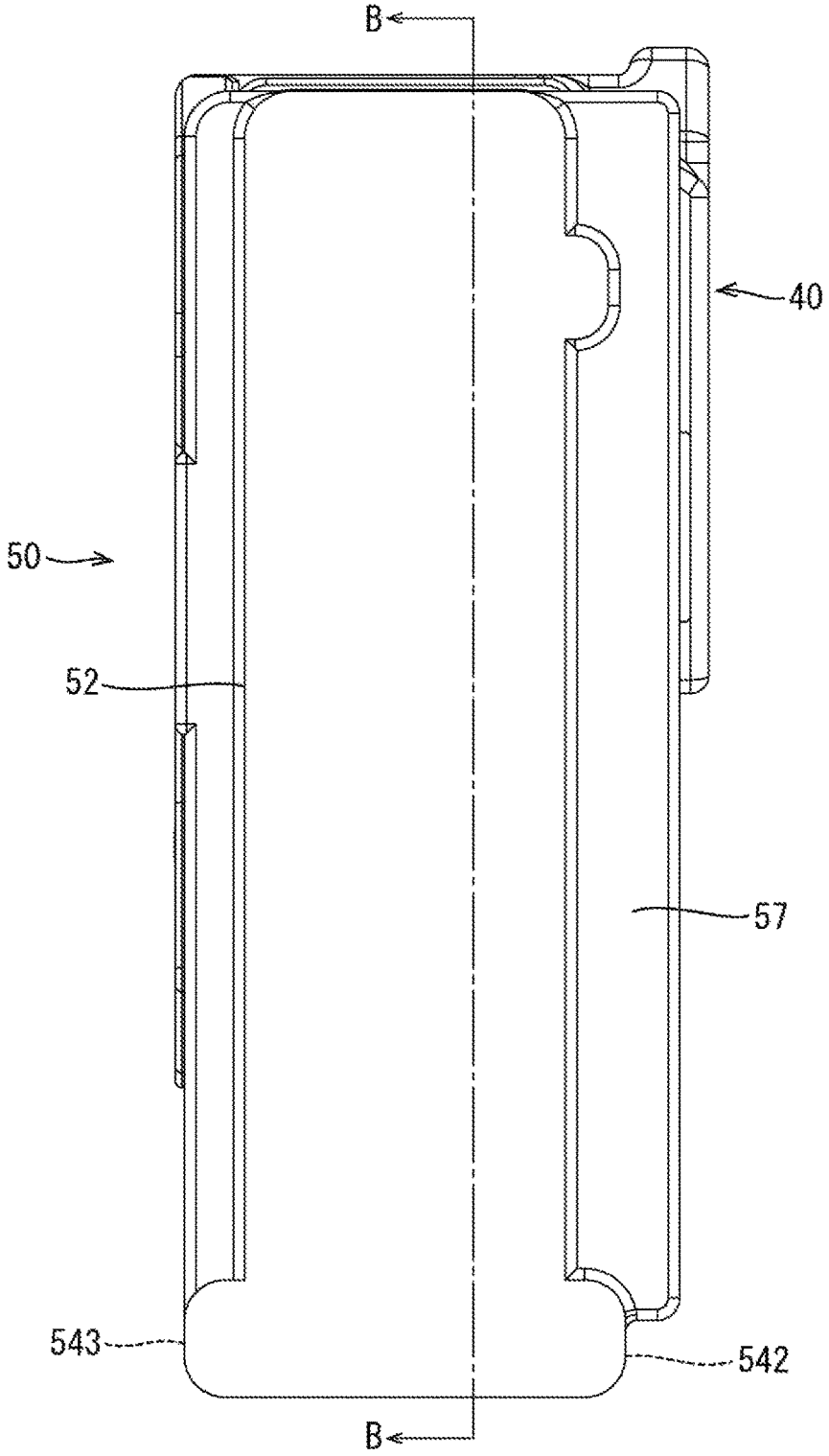
FIG. 16 is a front view of the connector in a connected state when viewed from a front surface side of the female connector.

The protruding portion 47 is set to slide in contact with the small receptacle 30 from a connection start position shown in FIG. 14 to the connected state shown in FIG. 24 by way of an intermediate connected state shown in FIG. 15.

Figure 9:
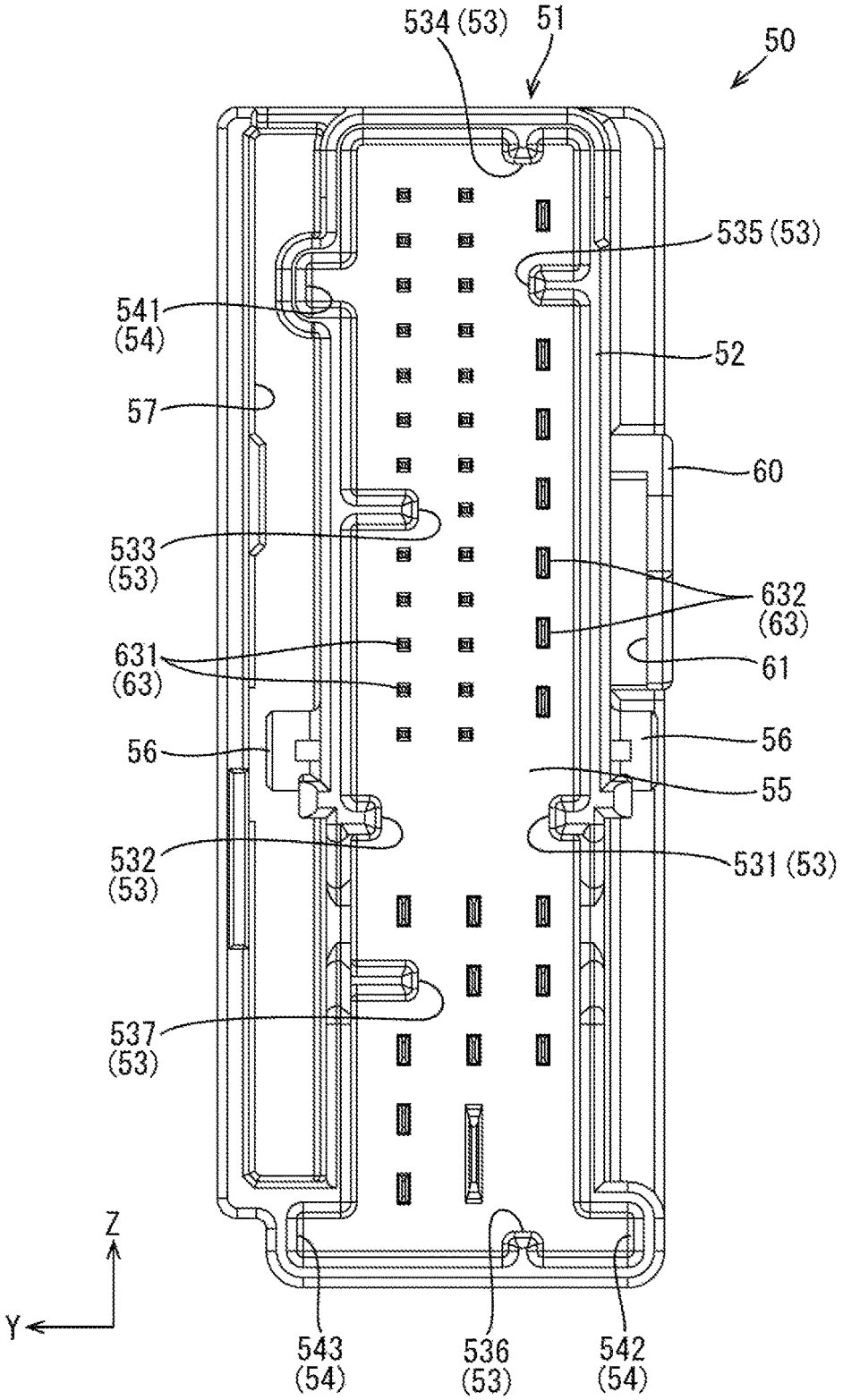
FIG. 9 is a front view of a male connector.
Figure 10:
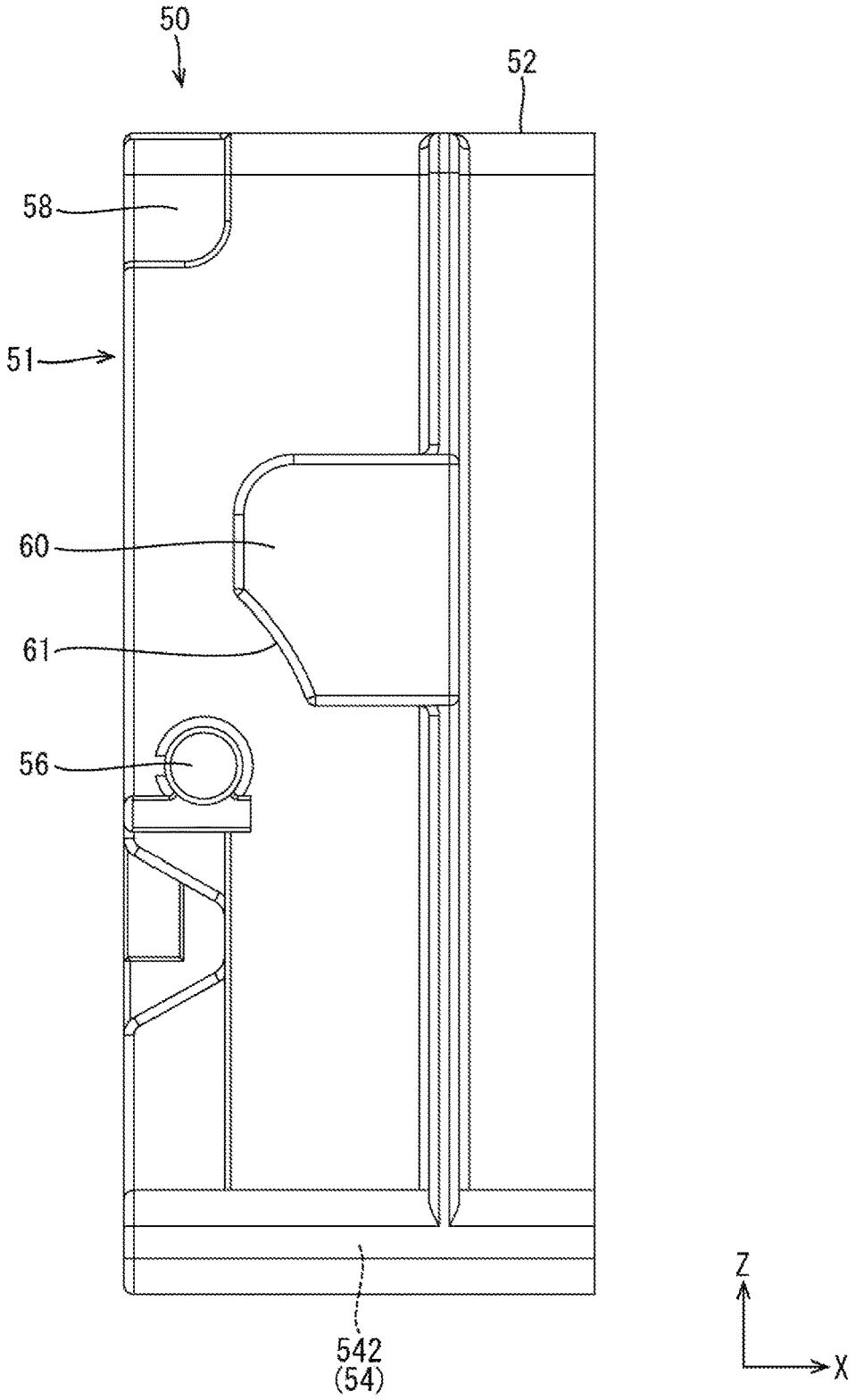
FIG. 10 is a left side view of the male connector.
Figure 11:
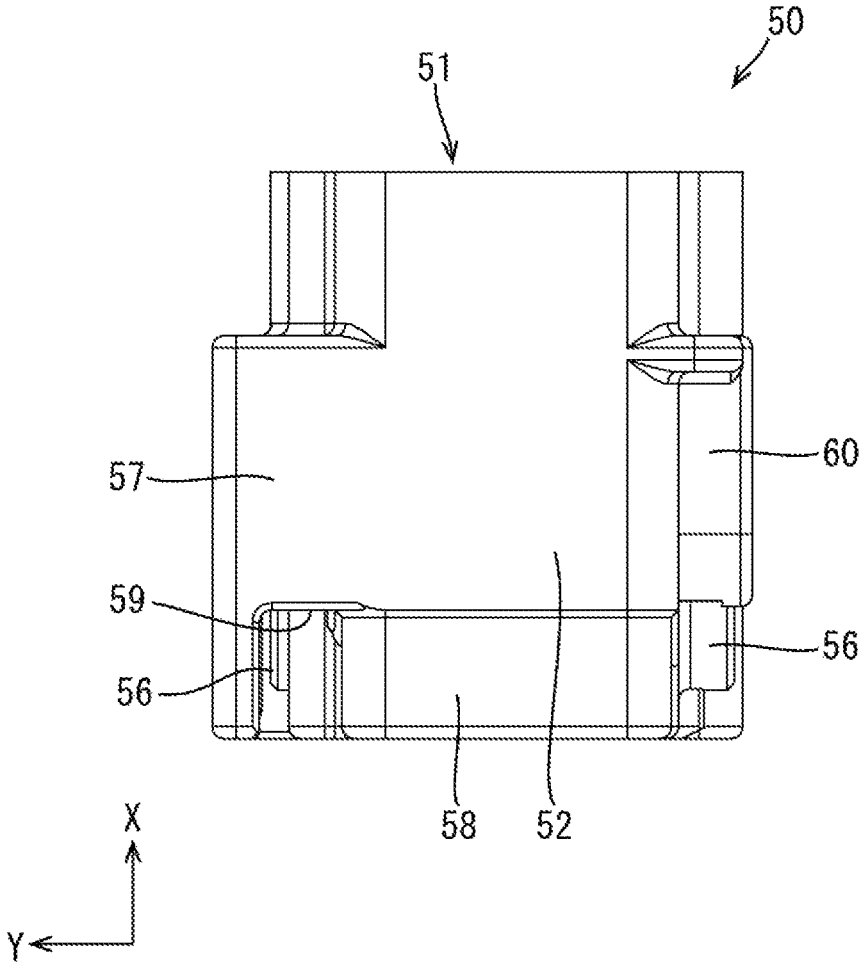
FIG. 11 is a plan view of the male connector.

On the other hand, the male connector 50 shown in FIGS. 9 to 11 includes the male connector housing 51 made of synthetic resin and having a forwardly open receptacle 52. The receptacle 52 is a vertically long rectangular parallelepiped case and is dimensioned to receive the female connector housing 11 inside.

The receptacle 52 is provided with male-side first to seventh guiding ribs 531 to 537 to be fit into the female-side first to seventh guiding grooves 261 to 267 of the female connector housing 11 described above and projecting inward. The male-side first to seventh guiding ribs 531 to 537 are formed at positions corresponding to the female-side first to seventh guiding grooves 261 to 267. The plural male-side ribs can prevent a worker's fingers from entering the male connector housing 51 by mistake.

The receptacle 52 is provided with male-side first to third guiding grooves 541 to 543 protruding outward, and the female-side first to third guiding ribs 271 to 273 of the female connector housing 11 described above are fit into the male-side first to third guiding grooves 541 to 543.

Tab-like male terminals 63 (first terminals 631, second terminals 632) project forward inside the receptacle 52. The male terminals 63 are arranged at positions corresponding to the female terminals accommodated in the cavities 13 (first cavities 131, second cavities 132) of the female connector housing 11. The male terminals 63 are fixed to a back wall 55 of the receptacle 52 by press-fitting or insert molding.

Two cylindrical cam pins 56 project at positions facing each other near centers of outer surfaces of the receptacle 52 in the height direction to be engaged with the cam grooves 44 of the lever 40. The cam pins 56 engage the cam grooves 44 of the lever 40 to exhibit the cam action.

A forwardly open lever accommodating portion 57 is provided to the right of (left side in FIG. 9) and side by side with the receptacle 52. As shown in FIG. 9, the lever accommodating portion 57 is smaller than the receptacle 52 and a right arm 42R of the lever 40 mounted on the female connector housing 11 can be accommodated therein.

As shown in FIG. 11, the lever accommodating portion 57 is disposed such that a front end (lower side in FIG. 11) is at the same position as the front end of the receptacle 52 and a rear end is in front of the rear end of the receptacle 52, and has a depth that is about ⅓ of that of the receptacle 52 in the front-rear direction (X direction). Further, as shown in FIG. 9, the upper end of the lever accommodating portion 57 is at the same height as that of the receptacle 52, whereas the lower end thereof is disposed slightly above a bottom wall of the receptacle 52 so that the male-side third guiding groove 543 provided in the receptacle 52 is allowed to escape downward. Note that the cam pin 56 on a right side wall (left side in FIG. 9) of the receptacle 52 is disposed in the lever accommodating portion 57. Further, the male-side first guiding groove 541 also is disposed to protrude into the lever accommodating portion 57.

Figure 21:
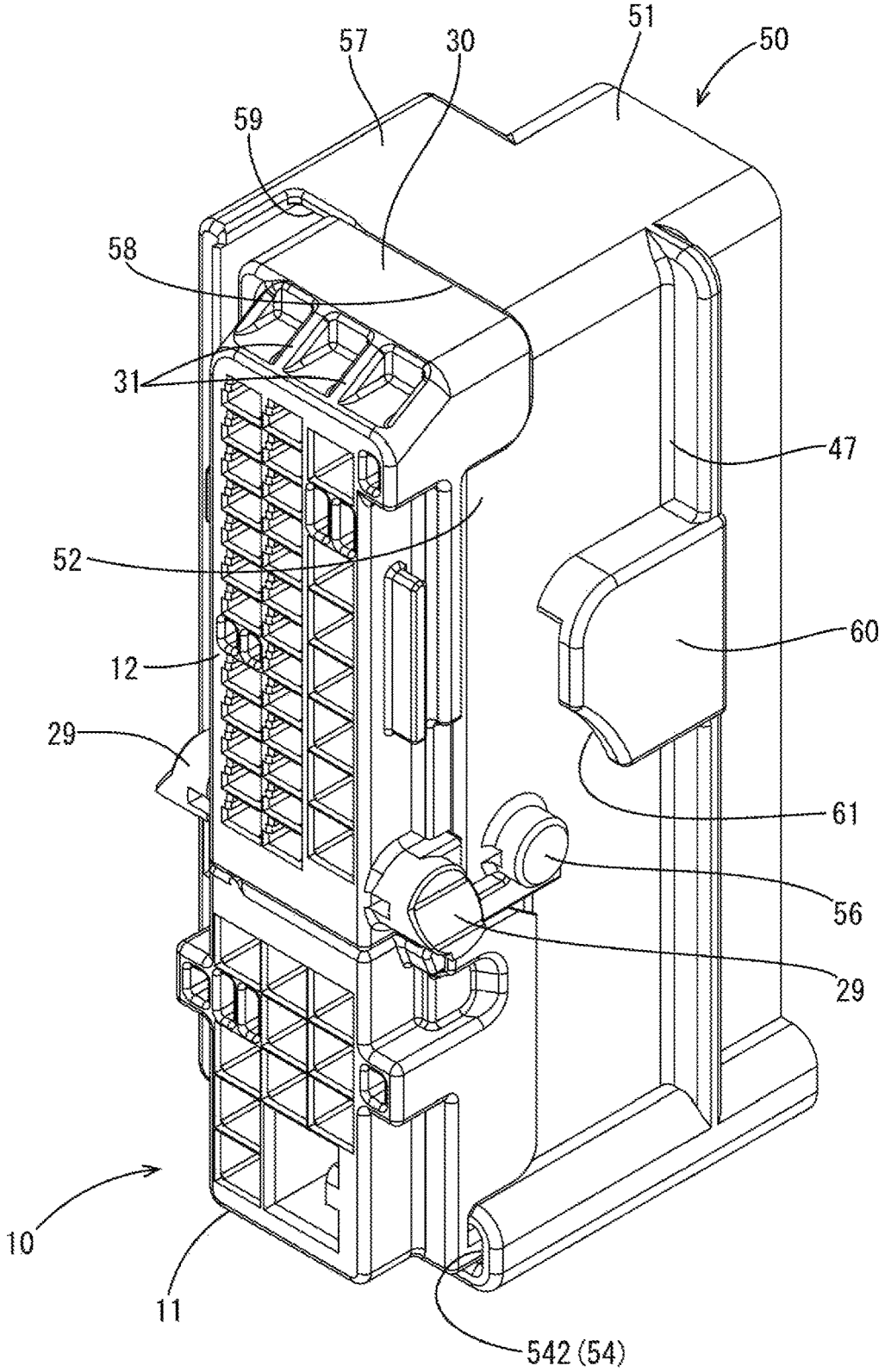
FIG. 21 is a perspective view of the connector in the connected state with a lever omitted when obliquely viewed from the back of the female connector.
Figure 22:
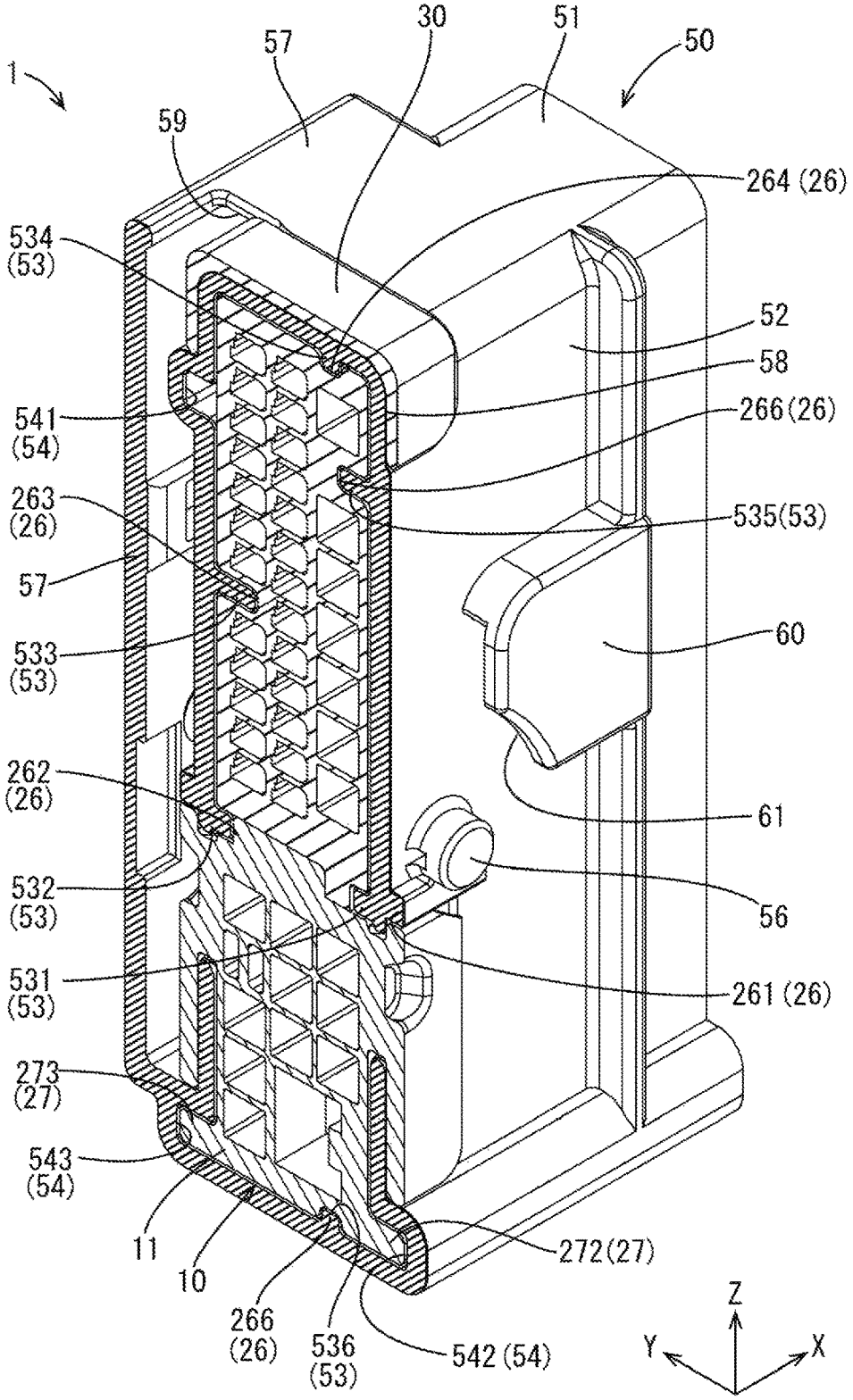
FIG. 22 is a rear perspective view partly in section of the female connector in the connected state with the lever omitted.

As shown in FIGS. 11 and 21, the male connector housing 51 (receptacle 52 and lever accommodating portion 57) is provided with a small receptacle mounting portion 58 recessed in a stepped manner by cutting parts of outer surface sides of an upper wall and a left side wall (right side in FIGS. 11 and 22) in a wall thickness direction from a front end toward a rear side. The small receptacle mounting portion 58 is an area where the small receptacle 30 of the female connector housing 11 described above is fit externally. In the connected state of the female and male connectors 10, 50, the small receptacle mounting portion 58 of the male connector housing 51 is fit tightly in the fitting space S between the body 12 and the small receptacle 30 of the female connector housing 11, as shown in FIG. 18.

Figure 18:
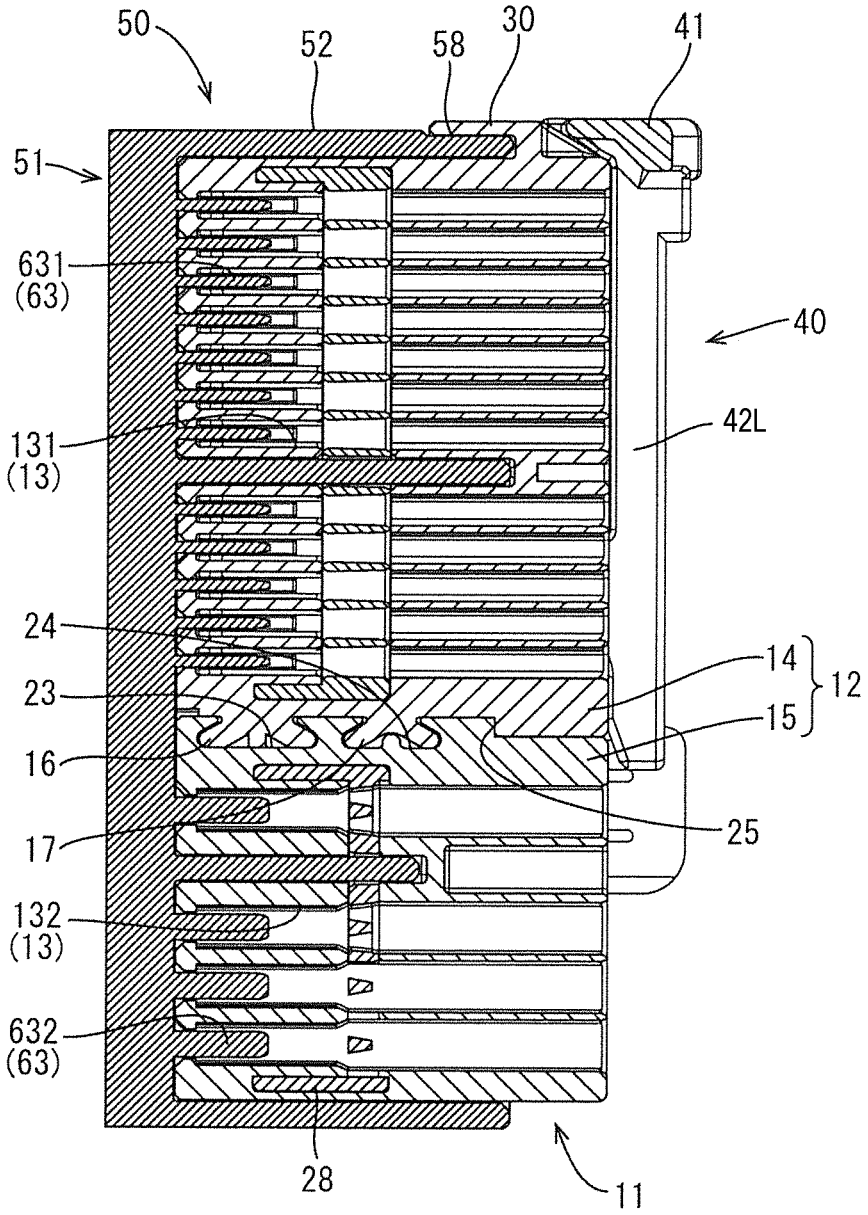
FIG. 18 is a section along B-B of FIG. 16.
Figure 19:
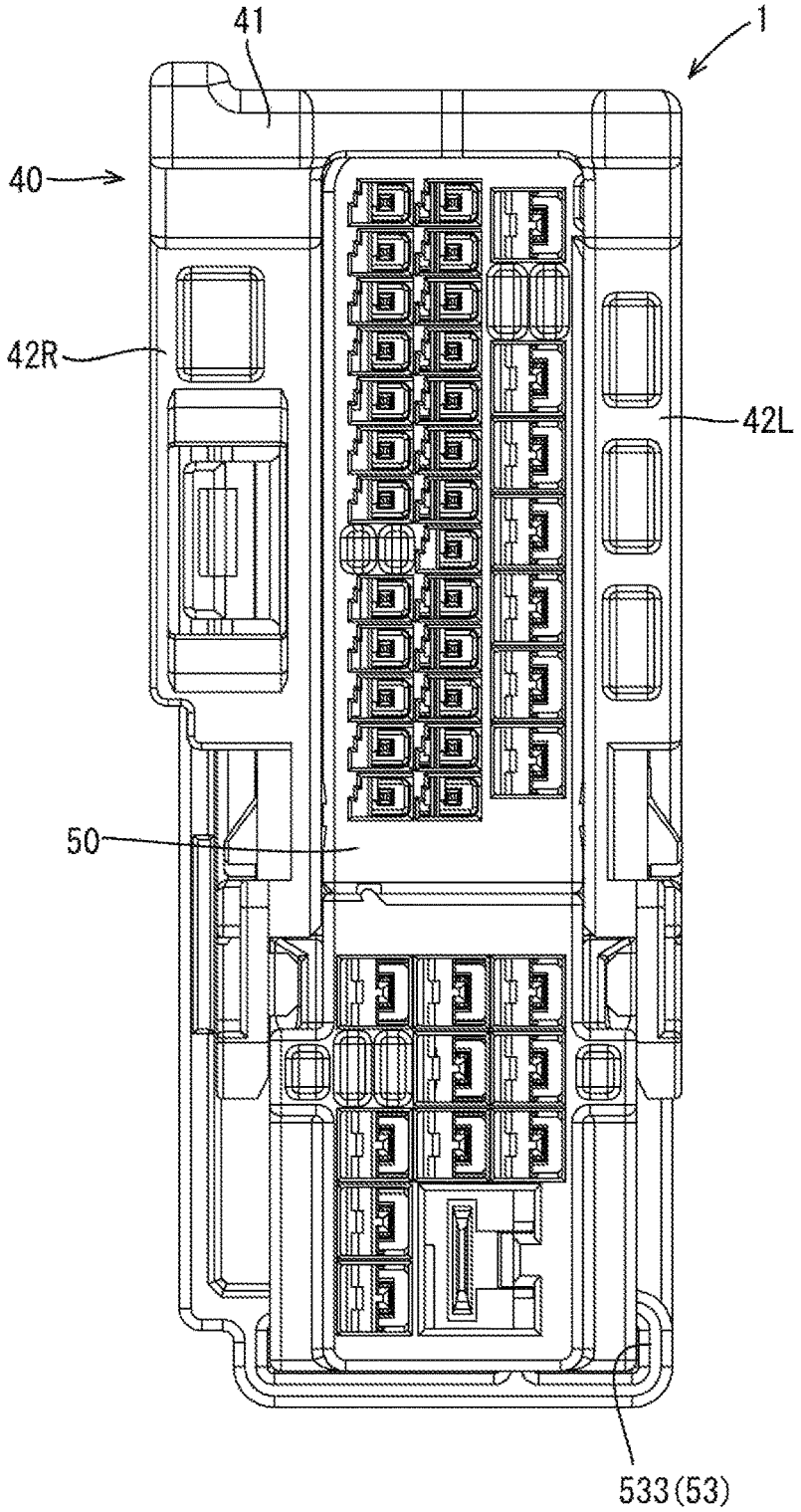
FIG. 19 is a rear view of the connector in the connected state of the female connector.
Figure 23:
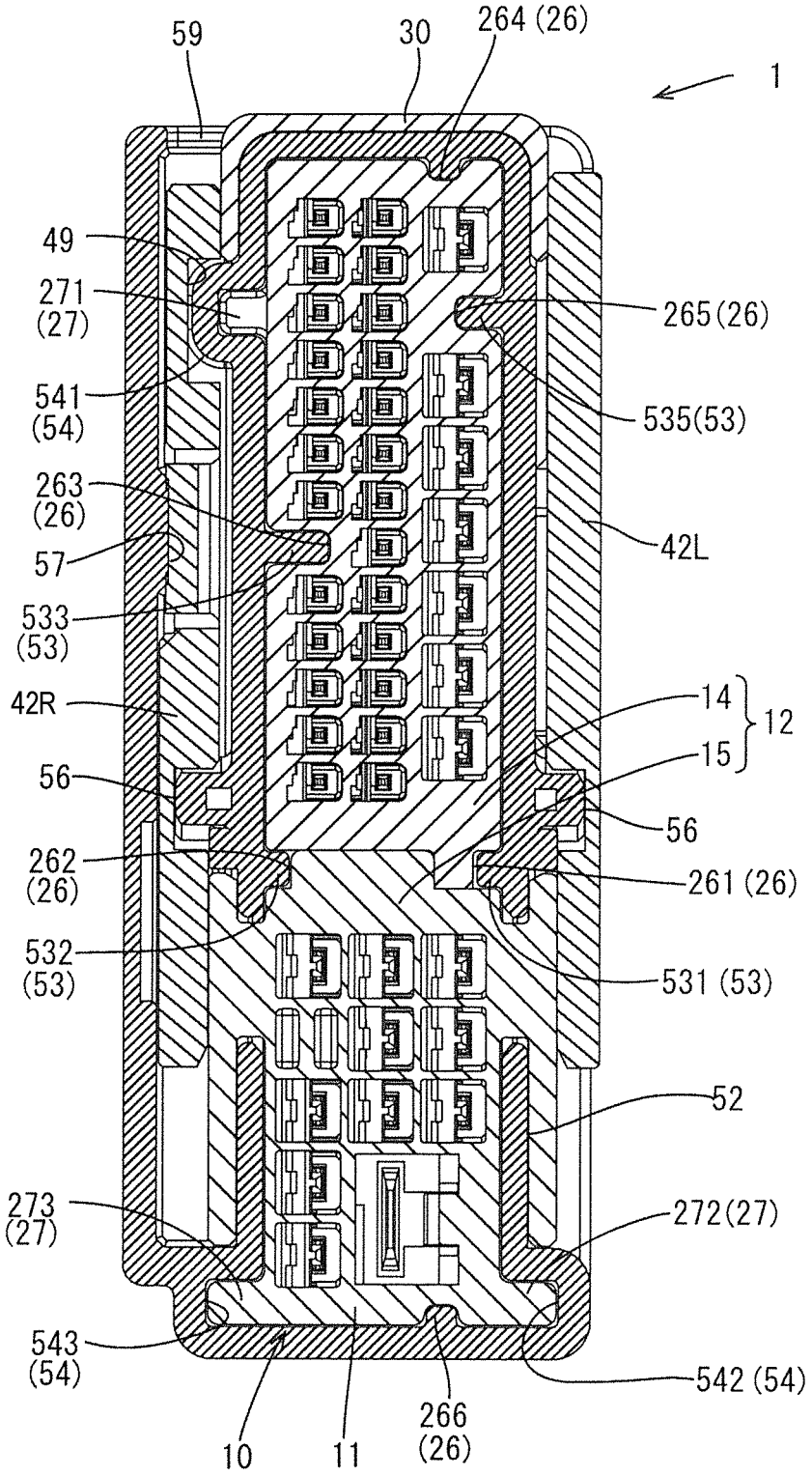
FIG. 23 is a section of the connector in the connected state when viewed from the back of the female connector.

A dimension of a step of the small receptacle mounting portion 58 is smaller than a thickness of a wall of the small receptacle 30, so that the outer surface of the small receptacle 30 projects slightly from the outer surface of the receptacle 52 in the connected state shown in FIGS. 18 and 23.

A cut 59 is provided adjacent to the right of (left side in FIGS. 11 and 22) of the small receptacle mounting portion 58 in the male connector housing 51 for allowing the right wall of the small receptacle 30 to escape down.

Figure 12:
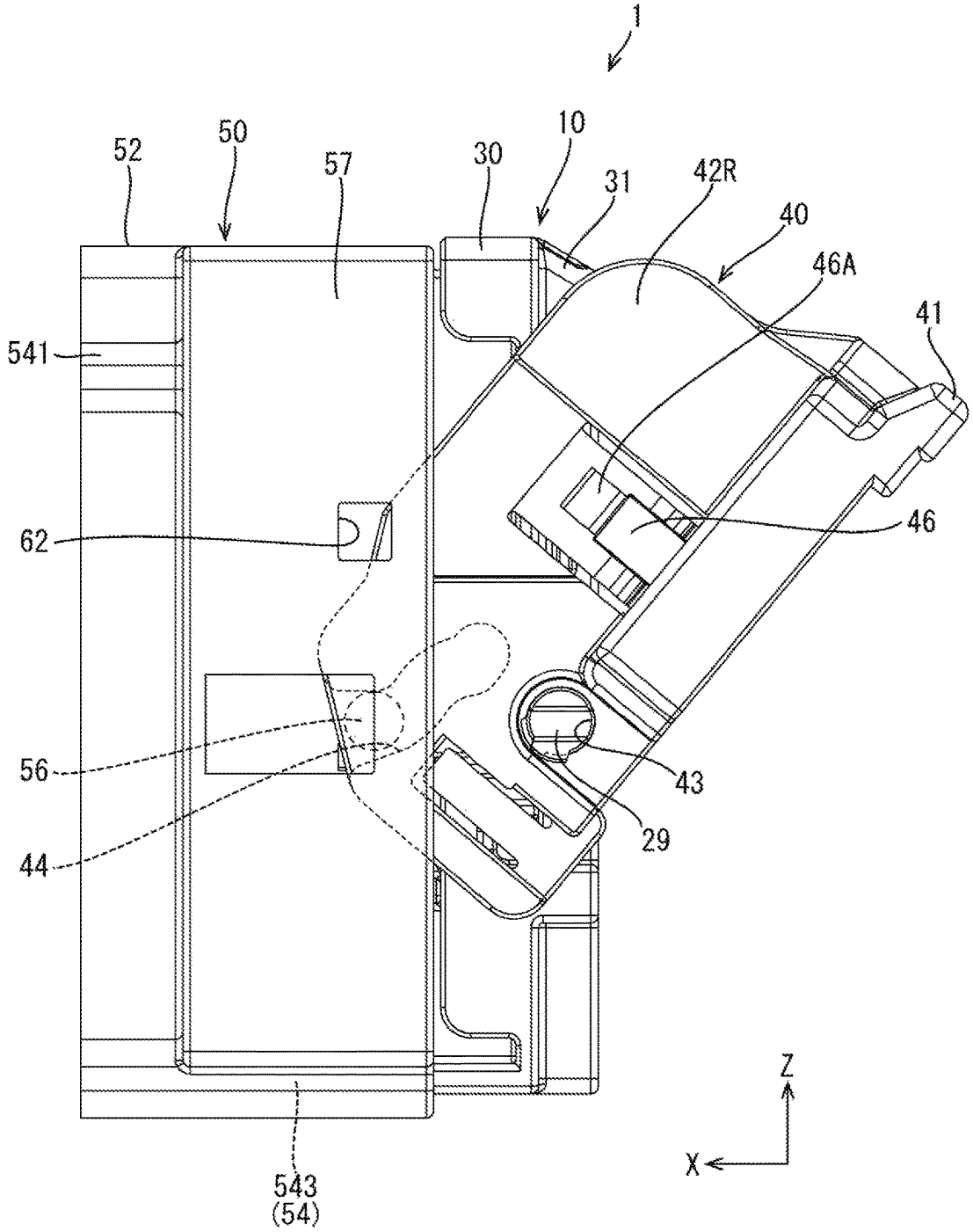
FIG. 12 is a right side view of a connector in a connecting process
Figure 13:
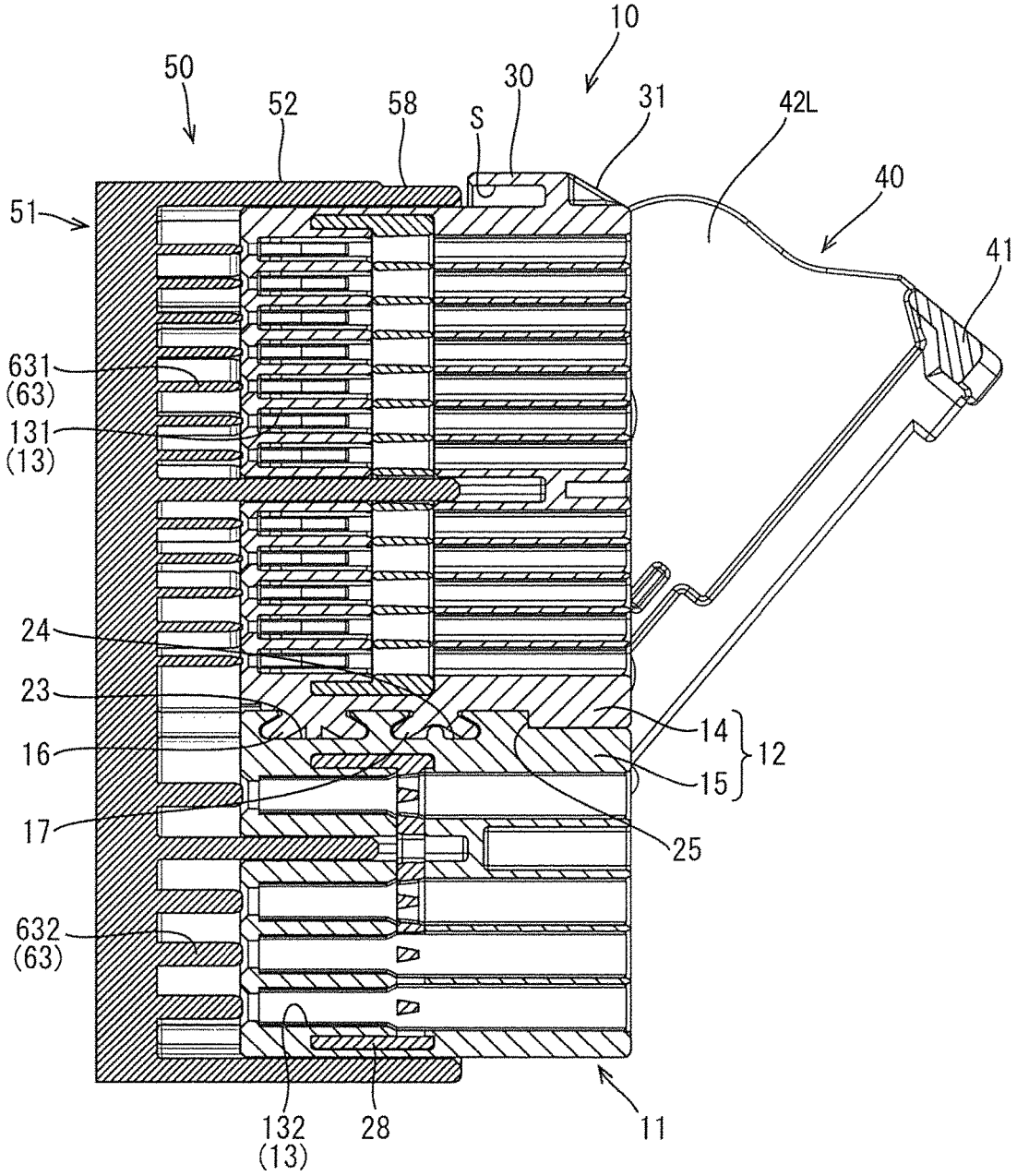
FIG. 13 is a right side sectional view of the connector in the connecting process.
Figure 17:
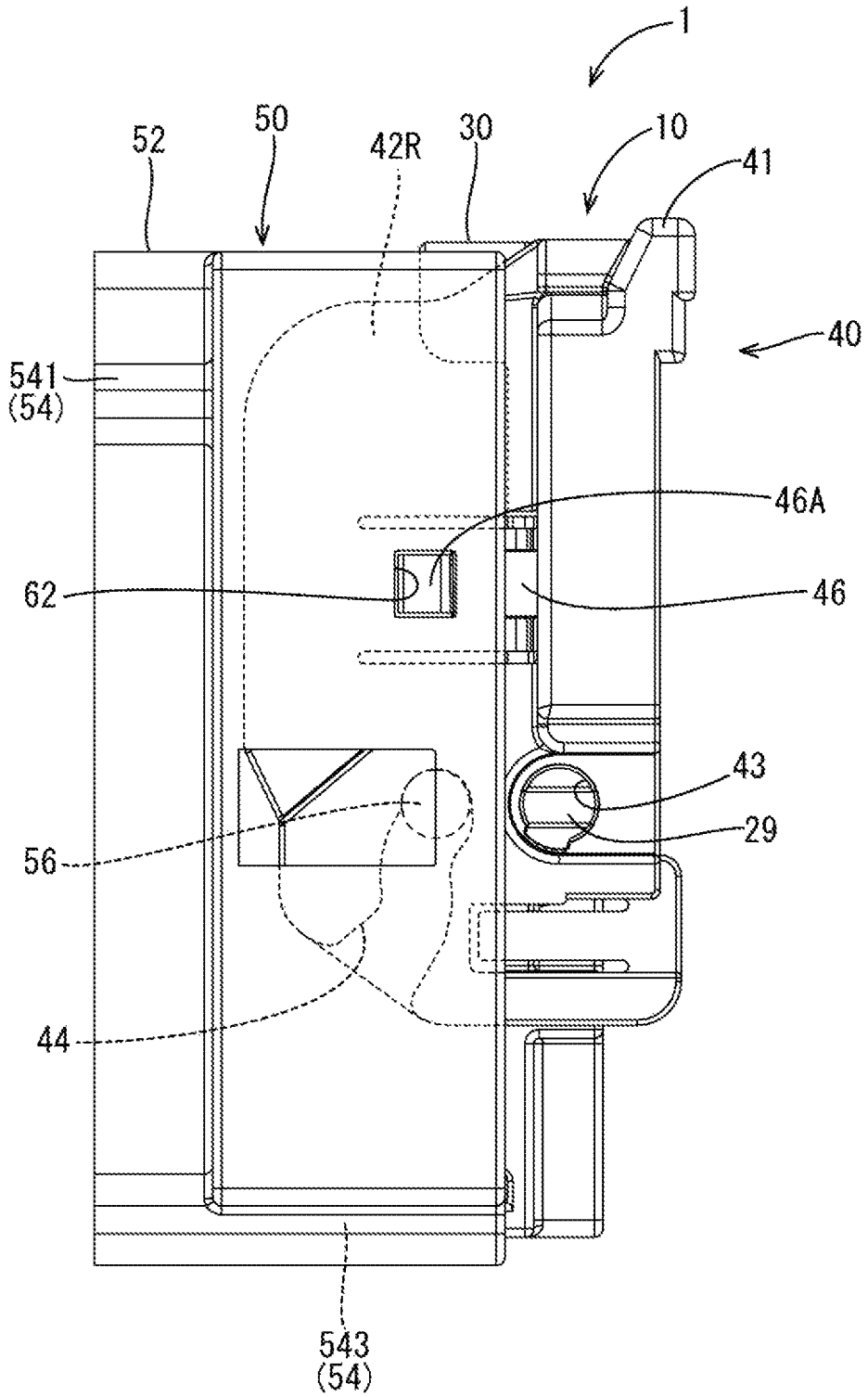
FIG. 17 is a right side view of the connector in the connected state.

The rectangular lock hole 62 for locking the locking claw 46A of the lock piece 46 of the lever 40 penetrates through the right side wall of the lever accommodating portion 57 (male connector housing 51) in a state where the lever 40 is disposed at the connection position (see FIGS. 12 and 17).

Furthermore, the flat restricting portion 60 projecting while being stepped from the left side surface is provided near a central part of the left side surface of the receptacle 52 (male connector housing 51) (see FIG. 21). The restricting portion 60 is for restricting excessive rotation of the lever 40 and, in the connected state of the connectors 10, 50, is in contact with the protruding portion 47 of the left arm 42L to restrict excessive rotation of the lever 40 as shown in FIG. 24.

Figure 20:
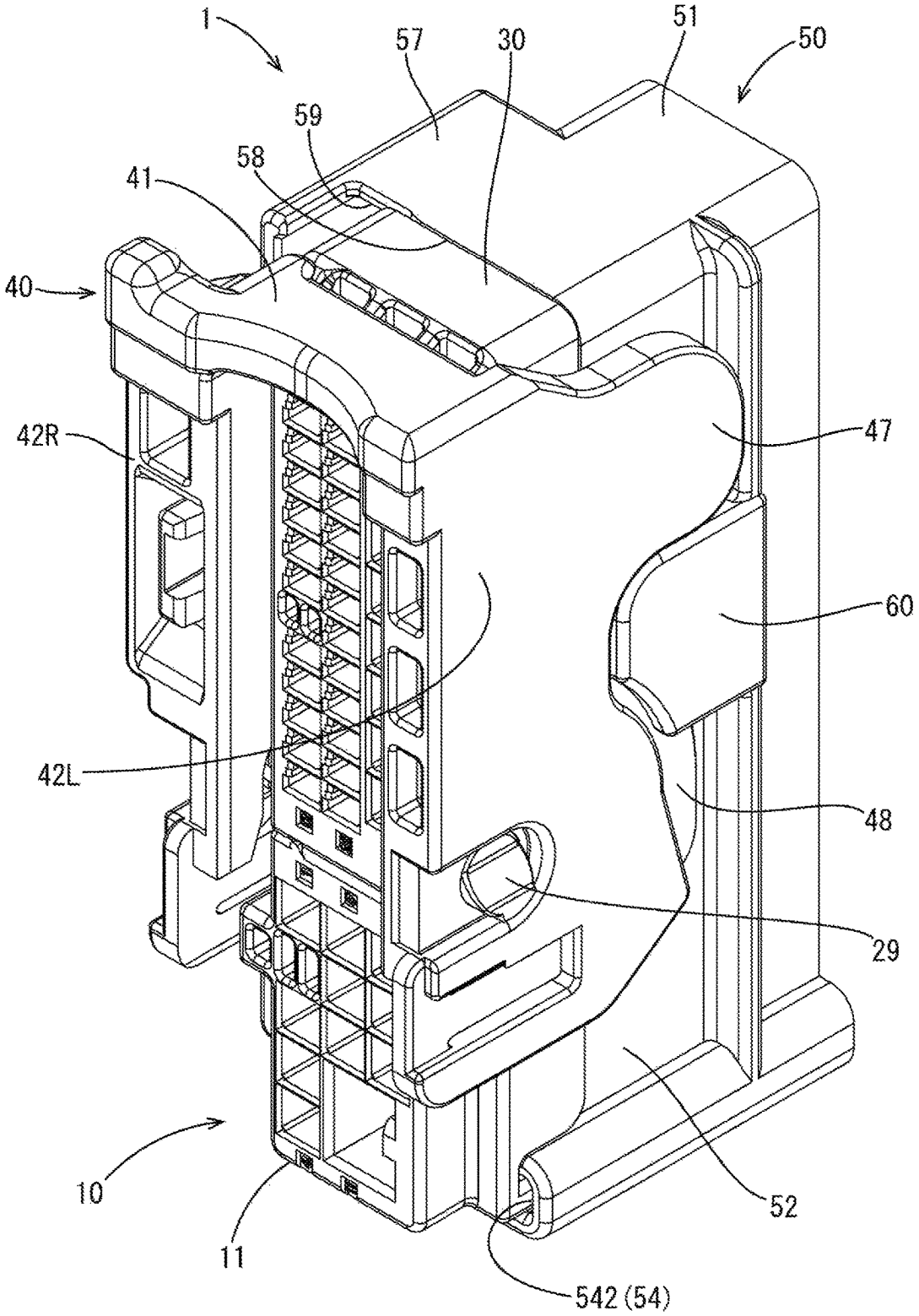
FIG. 20 is a perspective view of the connector in the connected state when obliquely viewed from the back surface side of the female connector.

As shown in FIG. 21, the restricting portion 60 has a stepped part on a rear side (left side in FIG. 21) and a lower side partly cut to form an accommodating portion 61, and the separation of the left arm 42L and eventually the lever 40 from the connector 1 in the connected state is restricted by the retaining portion 48 of the left arm 42L of the lever 40 described above being accommodated into this accommodating portion 61 (see FIGS. 20 and 24).

The connector 1 of this embodiment is configured as described above. Next, functions and effects of the connector 1 are described.

First, the front end of the female connector 10 with the lever 40 set at the standby position is inserted into the receptacle 52 of the male connector 50. The cam pins 56 of the male connector 50 then enter the cam grooves 44 of the lever 40.

Subsequently, the lever 40 is rotated from the standby position to the connection position. Then, the cam pins 56 relatively move to back sides of the cam grooves 44 and the connection of the both female and male connectors 10, 50 proceeds by this cam action.

At this time, the female-side first to third guiding ribs 271 to 273 provided on the body 12 of the female connector 10 are inserted into the male-side first to third guiding grooves 541 to 543 provided in the receptacle 52 of the male connector 50 (convex-concave engagement), and the male-side first to seventh guiding ribs 531 to 537 on the receptacle 52 are inserted into the female-side first to seventh guiding grooves 261 to 267 in the body 12 (convex-concave engagement). Thus, connecting postures of the female and male connectors 10, 50 are guided into proper postures.

Further, the right arm 42R of the lever 40 is inserted into the lever accommodating portion 57 of the male connector housing 51. On the other hand, the left arm 42L of the lever 40 is rotated along the left side surface of the receptacle 52 of the male connector housing 51 while sliding in contact with the small receptacle 30 and faces the outer left side surface across a predetermined clearance (clearance enabling the small receptacle 30 to escape inward) (see FIG. 23).

Furthermore, when the connection of the female and male connectors 10, 50 proceeds and the tip of the receptacle 52 of the male connector 50 reaches the tip of the small receptacle 30 of the female connector 10, the receptacle 52 is inserted into the fitting space S between the small receptacle 30 and the body 12 (see FIG. 18).

When the lever 40 is rotated to the connection position and the female and male connectors 10, 50 are connected properly, the locking claw 46A on the tip of the lock piece 46 provided on the right arm 42R of the lever 40 is locked into the lock hole 62 of the male connector housing 51. Thus, the female and male connectors 10, 50 are locked in the connected state (see FIG. 17).

In this connecting process, wires W pulled out rearward from the cavities 13 of the female connector housing 11 are guided promptly to the outside by the inclined outer surfaces of the guiding portions 31 of the small receptacle 30 and the smooth side edge of the protruding portion 47 of the left arm 42L, as shown in FIGS. 14, 15 and 24. Further, as described above, the small receptacle 30 and the left arm 42L slide in contact with each during rotation with no clearance. Thus, the wires W cannot be caught between the small receptacle 30 and the left arm 42L by mistake.

In the connected state, the protruding portion 47 of the left arm 42L of the lever 40 is in contact with the restricting portion 60, thereby restricting excessive rotation of the lever 40. Further, a part of the retaining portion 48 of the left arm 42L is accommodated into the accommodating portion 61 of the restricting portion 60, thereby restricting the separation of the left arm 42L and eventually the lever 40 from the connector 1 in the connected state (see FIG. 24).

Further, in this connected state, the tip of the receptacle 52 of the male connector 50 is fit tightly in the fitting space S between the body 12 and the small receptacle 30 of the female connector 10. Specifically, in this state, the small receptacle 30 covers the upper surface of the small receptacle mounting portion 58 provided on the tip of the male connector housing 51 (receptacle 52) and upper parts of the side surfaces of the receptacle 52 from outside (see FIG. 23).

According to the connector 1 of this embodiment as just described, the female connector 10 is provided with the small receptacle 30 disposed outside the receptacle 52 in the connected state to the male connector 50 to cover an upper part of the tip of the receptacle 52 from upper and lateral sides.

Thus, even if rainwater on an umbrella falls on the connector 1 from above or drink spills over the connector 1, water flows down along the small receptacle 30 covering a boundary between the receptacle 52 of the male connector 50 and the body 12 of the female connector 10 from above and penetration of water into the connector 1 through a clearance between the receptacle 52 and the body 12 is suppressed. In addition, since the small receptacle 30 only covers the tip part of the receptacle 52 from above and is not provided in a lower part of the connector 1, the connector 1 has a simple structure and is small as compared to general waterproof connectors.

Further, the receptacle 52 and the body 12 are provided with guiding portions composed of the guiding ribs 271 to 273, 531 to 537 and the guiding grooves 261 to 267 and 541 to 543 arranged to face each other in the connected state and configured to guide the female and male connectors 10, 50 along the connecting direction by convex-convex engagement and, out of these, two guiding portions are provided at positions below and adjacent to the lower end of the small receptacle 30 and facing each other with respect to the body 12.

One of the pair of guiding portions is composed of the male-side fifth guiding rib 535 provided on the receptacle 52 and projecting inward and the female-side fifth guiding groove 265 provided in the body 12, and the other is composed of the female-side first guiding rib 271 provided on the body 12 and projecting out and the male-side first guiding groove 541 provided in the receptacle 52.

As just described, if the guiding rib 27 (female-side first guiding rib 271) projecting outward from the body 12 is provided, the guiding groove 54 (male-side first guiding groove 541) for receiving the guiding rib 27 is provided to project on the outer surface side of the receptacle 52. Thus, in the case of providing the small receptacle 30 for covering a part of the receptacle 52 as in this embodiment, the small receptacle 30 stands as a hindrance and it may not be possible to provide the guiding groove 54 at a desired position in the receptacle 52.

To avoid such a problem, in this embodiment, a guiding function can be obtained by providing the guiding portions for guiding the female and male connectors 10, 50 in the connecting direction at positions maximally close to the upper end part of the connector 1 (positions below and adjacent to the lower end of the small receptacle 30) and facing each other with respect to the body 12 even if the small receptacle 30 is provided on the female connector 10.

Further, since the male-side guiding rib 53 projecting in from the receptacle 52 and the female-side guiding rib 27 conversely projecting out from the body 12 are combined and provided at the positions facing each other with respect to the body 12, the guiding function can be obtained more effectively.

Further, the body 12 is formed by assembling the first and second divided bodies 14, 15 divided along the connecting direction of the female and male connectors 10, 50, the first and second cut portions 21, 22 cut along the connecting direction are formed on the side edge parts disposed along the connecting direction (X direction) of the female and male connectors 10, 50 out of the side edge parts of the facing surfaces 14A, 15A of the first and second divided bodies 14, 15 disposed to face each other, and these first and second cuts 21, 22 serve as the female-side first and second guiding grooves 261, 262 for receiving the male-side first and second guiding ribs 531, 532 provided to project in along the connecting direction on the receptacle 52.

According to this configuration, a part of an area where an assembling mechanism for assembling one and the other divided bodies has been conventionally disposed can be utilized as an area where the guiding portions at the time of connector connection are provided.

The connector 1 of this embodiment as just described can have a small size and make it difficult for water to easily penetrate into the inside of the connector 1.

This specification is not limited to the above described and illustrated embodiment. For example, the following embodiments are also included in the scope.

Although the small receptacle 30 is substantially gate-shaped and covers the tip of the receptacle from upper and lateral sides in the above embodiment, the small receptacle 30 may cover only the upper side.

Although the receptacle 52 is fit tightly into the fitting space S enclosed by the small receptacle 30 and the body 12 in the above embodiment, the small receptacle 30 may be provided at a position more distant from the body 12 and the tip of the receptacle 52 may be covered from a distant position.

The positions and numbers of the guiding ribs and the guiding grooves are not limited to those in the above embodiment and can be appropriately changed.

Further, convex and concave orientations of the guiding portions (guiding ribs and guiding grooves) are also not limited to those in the above embodiment.

Although the guiding portions 31 provided on the small receptacle 30 obliquely extend to couple the upper surface of the small receptacle 30 and the back surface of the body 12 and couple the back surface of the small receptacle 30 and the upper surface of the body 12 in the above embodiment, the guiding portions 31 may be in the form of oblique plates merely coupling the upper surface of the small receptacle 30 and the back surface of the body 12.

Although the left arm 42L of the lever 40 and the small receptacle 30 slide in contact in the above embodiment, these may not necessarily slide in contact. In short, a clearance between the left arm 42L and the small receptacle 30 only has to be dimensioned such that the wires W are not caught between both.

LIST OF REFERENCE SIGNS

1: connector
10: female connector
12: body
14: first divided body (divided body)
15: second divided body (divided body)
21: first cut portion
22: second cut portion
23, 24: receiving groove
26: female-side guiding groove (guiding portion)
27: female-side guiding rib (guiding portion)
30: small receptacle
31: guiding portion
40: lever
50: male connector
52: receptacle
53: male-side guiding rib (guiding portion)
54: male-side guiding groove (guiding portion
S: fitting space W: wire
X: connecting direction

What is claimed is:

1. A connector, comprising:

a male connector including a male connector receptacle with an open front end; and a female connector including:

a body with a front end to be fit into the male connector receptacle in a horizontal direction and a rear end opposite the front end, the body further having opposite top and bottom surfaces and opposite side surfaces extending between the top and bottom surfaces, and a small receptacle having a rear end connected to the rear end of the body and an open front end spaced rearward of the front end of the body, the small receptacle having a top wall spaced above the top surface of the body and opposite side walls spaced out from the side surfaces of the body, the side walls of the small receptacle extending only part of a distance between the top and bottom surfaces of the body so that the bottom surface of the body and lower areas of the side surfaces of the body are not covered by the small receptacle, the top wall and the side walls of the small receptacle being disposed outside the male connector receptacle in a connected state to the male connector to cover upper front areas of the receptacle while leaving lower front areas of the male connector receptacle uncovered.

2. The connector of claim 1, wherein:

the male connector receptacle and the body are provided with guiding portions arranged to face each other in the connected state and configured to guide the male connector and the female connector in a connecting direction by convex-concave engagement by extending along the connecting direction; and two of the guiding portions are provided at positions below and adjacent to a lower end of the small receptacle and facing each other with respect to the body.

3. A connector, comprising:

a male connector including a receptacle; and a female connector including a body to be fit into the receptacle, the body being fit into the receptacle in a horizontal direction, wherein:

the female connector is provided with a small receptacle disposed outside the receptacle in a connected state to the male connector to cover an upper part of a tip of the receptacle;

the receptacle and the body are provided with guiding portions arranged to face each other in the connected state and configured to guide the male connector and the female connector in a connecting direction by convex-concave engagement by extending along the connecting direction;

two of the guiding portions are provided at positions below and adjacent to a lower end of the small receptacle (30) and facing each other with respect to the body; and one of the pair of guiding portions is composed of a male-side guiding rib provided on the receptacle and projecting inward and a female-side guiding groove provided in the body, and the other is composed of a female-side guiding rib provided on the body and projecting outward and a male-side guiding groove provided in the receptacle.

4. The connector of claim 3, wherein:

the body is formed by assembling at least first and second divided bodies divided along a connecting direction of the male connector and the female connector;

a cut portion is formed by being cut along the connecting direction on at least one side edge part of the first and second divided bodies disposed along the connecting direction of the male connector and the female connector; and the cut portion serves as a female-side guiding groove configured to receive a male-side guiding rib projecting in and extending along the connecting direction on the receptacle.

* * * * *